US007273038B2

(12) United States Patent
Hayakawa

(10) Patent No.: US 7,273,038 B2
(45) Date of Patent: Sep. 25, 2007

(54) FUEL INJECTION CONTROL METHOD AND FUEL-INJECTION CONTROL DEVICE

(75) Inventor: Kunihiko Hayakawa, Odawara (JP)

(73) Assignee: Mikuni Corporation, Tokyo (JP)

( * ) Notice: Subject to any disclaimer, the term of this patent is extended or adjusted under 35 U.S.C. 154(b) by 115 days.

(21) Appl. No.: 10/538,235

(22) PCT Filed: Dec. 9, 2003

(86) PCT No.: PCT/JP03/15707

§ 371 (c)(1),
(2), (4) Date: Nov. 22, 2005

(87) PCT Pub. No.: WO2004/053317

PCT Pub. Date: Jun. 24, 2004

(65) Prior Publication Data

US 2006/0137661 A1 Jun. 29, 2006

(30) Foreign Application Priority Data

Dec. 10, 2002 (JP) ..... 2002-357769

(51) Int. Cl.
*F02M 51/06* (2006.01)

(52) U.S. Cl. ..... 123/478; 360/187

(58) Field of Classification Search ..... 123/478, 123/479; 361/160, 187
See application file for complete search history.

(56) References Cited

U.S. PATENT DOCUMENTS 4,877,273 A * 10/1989 Wazaki et al. ..... 290/40 C
6,208,497 B1 * 3/2001 Seale et al. ..... 361/160
6,516,773 B2 * 2/2003 Dutart et al. ..... 123/299
2006/0171091 A1 * 8/2006 Seale et al. ..... 361/160

FOREIGN PATENT DOCUMENTS

| | | |
|---|---|---|
| JP | 55-123325 | 9/1980 |
| JP | 56-527 | 1/1981 |
| JP | 58-28537 | 2/1983 |
| JP | 8-4575 | 1/1996 |
| JP | 2002-4921 | 1/2002 |
| JP | 2002-21679 | 1/2002 |

* cited by examiner

*Primary Examiner*—Thomas Moulis
(74) *Attorney, Agent, or Firm*—Wenderoth, Lind & Ponack, L.L.P.

(57) ABSTRACT

In order to perform accurate fuel injection control in response to fuel injection requests from the engine side without being affected by variations in power supply voltage and in coil temperature of a fuel injection solenoid and by other external factors, driving of the fuel injection solenoid is controlled based on the actual current integral of the coil current flowing through the solenoid after starting driving the solenoid. More specifically, the present invention provides a fuel injection control method having the steps of starting driving of a fuel injection solenoid, detecting an actual current integral of a coil current that flows through the solenoid after starting the driving of the solenoid, comparing the actual current integral with a reference current integral beforehand set in relation to a driving pulse width for the solenoid corresponding to a required fuel injection amount, and correcting the driving pulse width for the solenoid based on comparison between the actual current integral and the reference current integral, where the driving of the solenoid is controlled based on the corrected driving pulse width.

19 Claims, 21 Drawing Sheets

FUEL INJECTION CONTROL METHOD AND FUEL-INJECTION CONTROL DEVICE

BACKGROUND OF THE INVENTION

1. Field of the Invention

The present invention relates to an electronic fuel injection control method and apparatus for supplying fuel to an internal-combustion engine (hereinafter, referred to as an "engine" as appropriate), and more particularly, to a fuel injection control method and apparatus for accurately supplying a fuel injection amount required from the engine side while eliminating effects due to variations in coil resistance of a fuel injection solenoid generated by variations in power supply voltage and temperature, and others.

2. Description of Related Art

It is extremely an important factor that affects the performance of the entire engine to supply fuel to the engine of a vehicle including a two-wheeled vehicle at suitable timing corresponding to a fuel injection amount required from the engine side that varies every instance. Therefore, an electronic fuel injection apparatus has been used that electronically controls the fuel injection to the engine using a microcomputer.

FIG. 20 illustrates a specific example of a control circuit of such an electronic fuel injection apparatus. In this example, a fuel injection amount per unit time injected from the fuel injection apparatus varies due to variations in power supply voltage (battery voltage), in view of which, the fuel injection time is adjusted using a level of the power supply voltage. In other words, the power supply voltage VB applied to a power supply terminal 11 is input to a microcomputer 13 of ECU (Electronic Control Unit) via a power supply voltage input circuit 12. When the power supply voltage VB is low, the microcomputer 13 outputs a driving pulse with a longer ON time of a FET 14 to a FET driving circuit 15 so as to adjust the driving time (fuel injection time) of a fuel injection solenoid 16 to be longer. Meanwhile, when the power supply voltage VB is high, the microcomputer 13 outputs a driving pulse with a shorter ON time of the FET 14 to the FET driving circuit 15 so as to adjust the driving time of the fuel injection solenoid 16 to be shorter. In this way, the fuel injection amount is controlled so that a required proper amount of fuel is supplied without being affected by variations in power supply voltage. An example of the fuel injection control method is disclosed in Patent Document 1 for thus adjusting a fuel injection amount by detecting a level of the battery voltage.

FIG. 21 shows an example of another well-known technique of control circuit for an electronic fuel injection apparatus. In the circuit, the power supply voltage VB applied to the power supply terminal 11 is detected in a power supply voltage detecting circuit 21, while a coil current of a fuel injection solenoid is detected using resistance 22 and current detecting circuit 23 added for current detection. Thus, the coil current is controlled not to vary due to variations in power supply voltage VB using the microcomputer 13 and a constant-current driving circuit 20.

Patent Document 2 describes an example of such an injector driving apparatus which detects a driving current flowing through an injector (fuel injection apparatus), and based on a detected value of the injector driving current, corrects a delay time in valve opening time of the injector.

Further, there is known a driving control apparatus of a fuel injection valve for an engine where a fuel temperature is detected in relation to a temperature of a fuel injection electromagnetic coil, a correction pulse width is set to compensate for an operation delay time in the fuel injection valve based on the fuel temperature and battery voltage, and a final injection pulse width is obtained by adding the correction pulse width to an effective injection pulse width corresponding to a fuel amount to supply to the engine (for example, Patent Document 3).

[Patent Document 1] Japanese Laid-Open Patent Publication No. S58-28537

[Patent Document 2] Japanese Laid-Open Patent Publication No. 2002-4921

[Patent Document 3] Japanese Laid-Open Patent Publication No. H08-4575

However, for example, in the control method as described in Patent Document 1 and FIG. 20 where the fuel injection time is corrected based on a level of the power supply voltage, when the temperature of the coil that composes the solenoid 16 increases, since the resistance of the coil varies and the coil current varies even in the same power supply voltage VB, it is difficult to supply a required fuel injection amount properly. This is because a fuel injection amount per unit time of the solenoid 16 varies with the coil current value.

Therefore, the fuel injection solenoid is driven with a constant current, or a delay in valve opening time of the injector is compensated based on a detected value of an injector driving current (coil current) as disclosed in Patent Document 2. However, the solenoid is affected by the temperature in its operation characteristics including the operation starting time after the voltage is supplied, and therefore, cannot respond to a fuel injection amount required from the engine side properly. Further, since the driving control circuit and the software processing is complicated, it is difficult to implement size reduction and cost reduction in the entire fuel injection apparatus.

Further, in the driving control apparatus of a fuel injection valve for an engine as disclosed in Patent Document 3, the temperature of fuel is measured to indirectly detect the temperature of an electromagnetic coil that is a factor for causing the operation characteristics to vary. However, the temperature of the electromagnetic coil does not agree with the temperature of fuel always, and the detecting means for detecting the temperature of fuel should be placed inside the fuel tank together with the driving control apparatus of a fuel injection valve for an engine, resulting in a problem that decreases a fuel storage capacity of the fuel tank corresponding to such placement.

SUMMARY OF THE INVENTION

In view of various issues in the conventional techniques as described above, it is an object of the present invention to provide a fuel injection control method and apparatus that enable a proper amount of fuel injection corresponding to a fuel injection amount required from the engine side without being affected by variations in power supply (battery) voltage and in coil temperature of a fuel injection solenoid and by other external factors.

Variations in power supply voltage and in coil temperature of a fuel injection solenoid have a strong correspondence with the actual current integral of a coil current that flows through the fuel injection solenoid after starting driving of the solenoid. In view of the foregoing, the fuel injection control method of the invention makes it possible to inject a proper amount of fuel corresponding to a fuel injection amount required from the engine side, by controlling the driving of the fuel injection solenoid based on the actual current integral.

A first aspect of the fuel injection control method has steps of starting driving of a fuel injection solenoid, detecting an actual current integral of a coil current that flows through the solenoid after starting the driving of the solenoid, comparing the actual current integral with a reference current integral beforehand set in relation to a driving pulse width for the solenoid corresponding to a required fuel injection amount, and correcting the driving pulse width for the solenoid based on comparison between the actual current integral and the reference current integral, and controls the driving of the solenoid based on the corrected driving pulse width.

A second aspect of the fuel injection control method has steps of starting driving of a fuel injection solenoid, detecting an actual current integral of a coil current that flows through the solenoid during a period of time the driving of the solenoid is started and then halted, comparing the actual current integral with a target current integral beforehand set in relation to a required fuel injection amount, and correcting a driving pulse width for the solenoid based on comparison between the actual current integral and the target current integral, and controls the driving of the solenoid based on the corrected driving pulse width.

A third aspect of the fuel injection control method has steps of starting driving of a fuel injection solenoid, detecting an actual current integral of a coil current that flows through the solenoid during a period of time the driving of the solenoid is started and then halted, calculating an estimated fuel injection amount corresponding to the actual current integral, comparing the estimated fuel injection amount with a required fuel injection amount, and correcting a driving pulse width for the solenoid based on comparison between the estimated fuel injection amount and the required fuel injection amount, and controls the driving of the solenoid based on the corrected driving pulse width.

The three aspects as described above correct a pulse width of a driving signal for a next fuel injection cycle based on the actual current integral of the coil current that flows through the solenoid during a period of time the driving of the solenoid is started and then halted. As a variation of each of the three aspects as described above, the present invention provides a fuel injection control method for detecting at real time the actual current integral of the coil current flowing after driving the solenoid, and based on the real-time value, correcting and adjusting drive halt timing for the solenoid in the relevant fuel injection cycle.

In the present invention, the method includes the step of resetting the actual current integral every driving cycle of the fuel injection solenoid.

The present invention further provides a fuel injection control apparatus corresponding to the fuel injection control method.

A first aspect of the fuel injection control apparatus is provided with driving means for driving a fuel injection solenoid, detecting means for detecting an actual current integral of a coil current flowing through the solenoid, and control means for controlling driving of the solenoid based on the actual current integral, where the control means has comparing means for comparing the actual current integral obtained after starting driving of the solenoid detected in the detecting means with a reference current integral beforehand set in relation to a driving pulse width for the solenoid corresponding to a required fuel injection amount, and correcting means for correcting the driving pulse width for the solenoid based on a result of comparison in the comparing means.

In a second aspect of the fuel injection control apparatus, the control means has comparing means for comparing the actual current integral obtained after starting driving of the solenoid detected in the detecting means with a target current integral beforehand set in relation to a required fuel injection amount, and correcting means for correcting a driving pulse width for the solenoid based on comparison between the actual current integral and the target current integral.

Further, the control means has calculating means for calculating an estimated fuel injection amount corresponding to the actual current integral obtained after starting driving of the solenoid, comparing means for comparing the estimated fuel injection amount with a required fuel injection amount, and correcting means for correcting a driving pulse width for the solenoid based on comparison between the estimated fuel injection amount and the required fuel injection amount.

Furthermore, as a variation of each of the three aspects as described above, the present invention provides a fuel injection control apparatus such that the detecting means detects at real time the actual current integral of the coil current flowing after driving the solenoid, and based on the real-time value, driving of the solenoid in the relevant fuel injection cycle is halted.

The means for detecting the actual current integral is an analog detecting circuit that detects a cumulative current value of the coil current or a digital detecting circuit that measures a value of the coil current at predetermined intervals to calculate.

According to the present invention, since there is a close correspondence between the integral of the current flowing through the coil of a fuel injection solenoid and a fuel injection amount, driving of the solenoid is controlled based on the actual current integral after starting driving the fuel injection solenoid, and thus, a proper amount of fuel injection is achieved corresponding to a fuel injection amount required from the engine side without undergoing effects on fuel injection characteristics imposed by the fuel injection apparatus even when variations occur in voltage to apply to the fuel injection solenoid and in coil temperature.

Further, in the present invention, it is possible to obtain the actual current integral of after starting driving the fuel injection solenoid successively not only after halting the driving of the solenoid but also during the driving, and the fuel injection control is thereby implemented that is capable of promptly responding to variations in power supply voltage, coil temperature, etc., and a required fuel injection amount varying every instant.

BRIEF DESCRIPTION OF THE DRAWINGS

FIG. 2(*b*) shows another example of the control circuit where the actual current integral is detected in digital processing;

DETAILED DESCRIPTION OF THE PREFERRED EMBODIMENTS

Embodiments of a fuel injection control method and apparatus according to the present invention will be described specifically below with reference to accompanying drawings.

Figure 1:
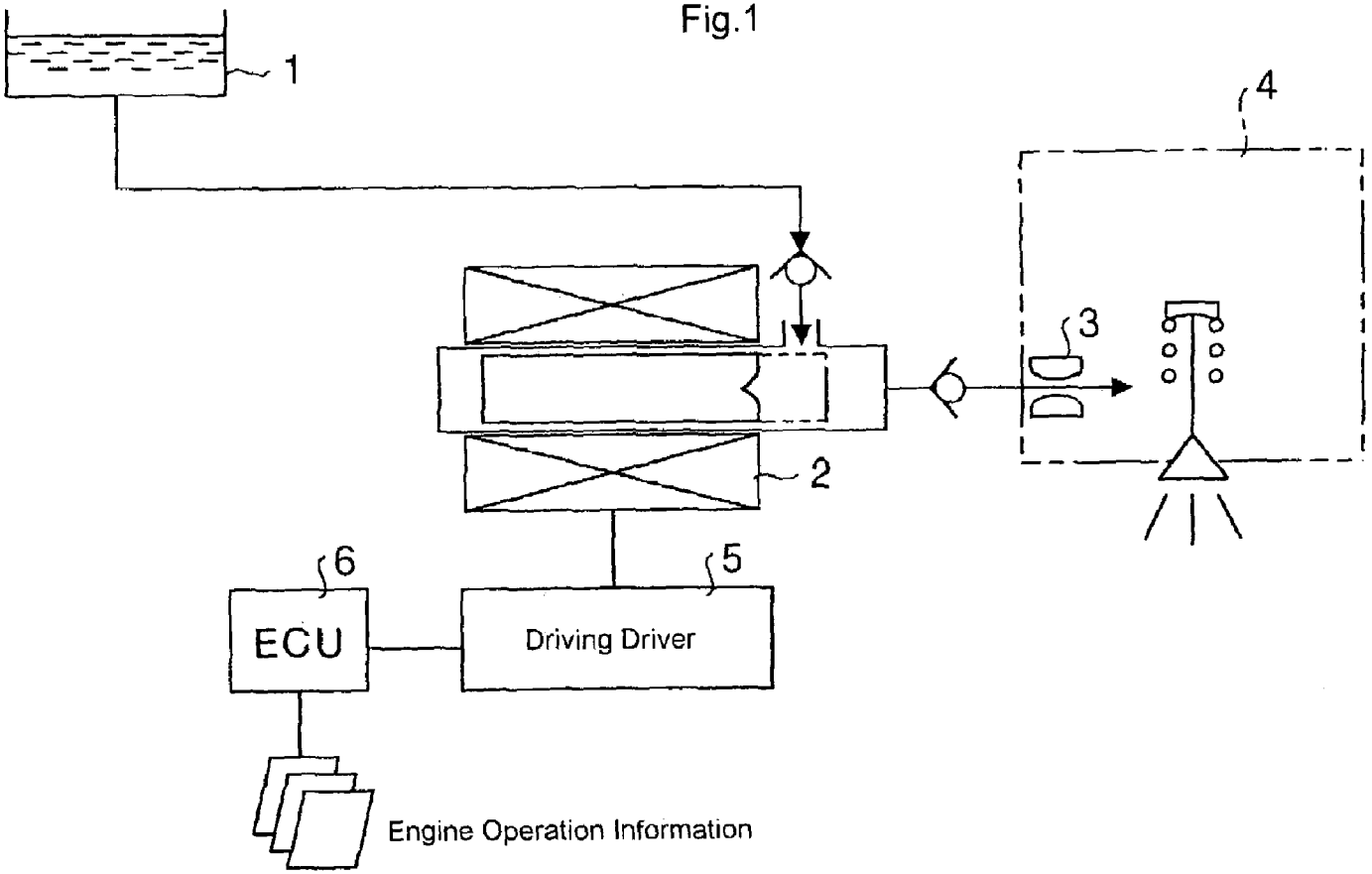
FIG. 1 illustrates a schematic configuration of an electromagnetic fuel injection system to which the present invention is applied.

FIG. 1 illustrates a schematic entire configuration of a fuel injection system (hereinafter, referred to as an "electromagnetic fuel injection system") using an electromagnetic fuel injection pump that pressurizes and injects fuel by itself, as distinct from a conventional fuel injection apparatus or fuel injection system that injects fuel pressurized and provided in/from a fuel pump or regulator.

Hereinafter, as preferred embodiments of the present invention, an example is described of applying the present invention to an electromagnetic fuel injection system. However, it is apparent that the present invention is applicable to other fuel injection systems where the coil current and driving start characteristic of a fuel injection solenoid vary with variations in power supply voltage and in temperature.

As shown in FIG. 1, the electromagnetic fuel injection system has as its basic configuration a plunger pump 2 that is an electromagnetically driven pump that pressurizes and feeds fuel inside a fuel tank 1, an inlet orifice nozzle 3 having an orifice portion through which is passed the fuel with predetermined pressure pressurized and fed in/from the plunger pump 2, an injection nozzle 4 that injects the fuel passed through the inlet orifice nozzle 3 with pressure higher than a predetermined value to an intake passage (of an engine), and a control unit (ECU) 6 configured to output a control signal to the plunger pump 2 and others based on operation information of the engine and coil current flowing through a solenoid (fuel injection solenoid in the present invention) of the plunger pump 2. Herein, the control means in the fuel injection control apparatus according to the present invention corresponds to the control unit 6.

First Embodiment

In the first embodiment of the present invention, based on a driving pulse width output at the time of fuel injection and the actual current integral obtained after starting driving the fuel injection solenoid, a driving pulse width to output in a next fuel injection cycle is corrected. In the present invention, the current integral that the fuel injection control apparatus has in advance as data is referred to as a "reference current integral", while the detected actual integral of the coil current is referred to as an "actual current integral".

Figure 2A:
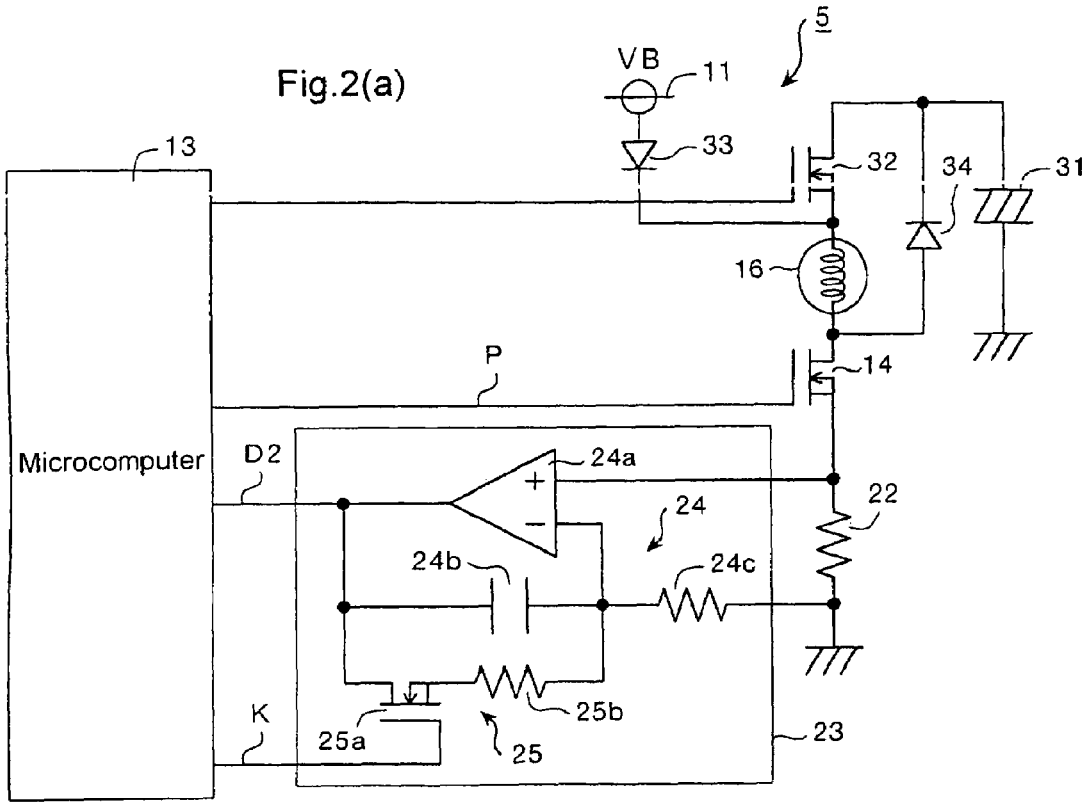
FIG. 2(*a*) shows an example of a control circuit composing a fuel injection control apparatus of the present invention, where an analog circuit is used in a portion that detects an actual current integral of a coil current flowing through a solenoid.
Figure 2B:
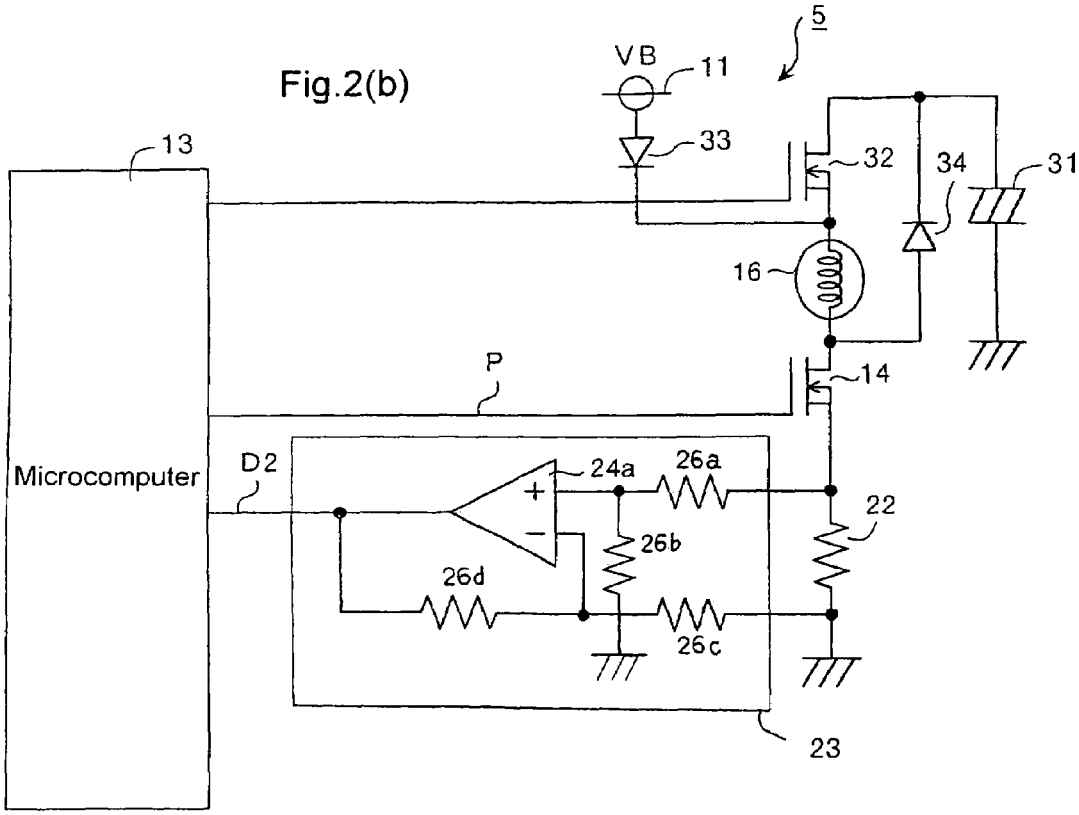

FIGS. 2(*a*) and 2(*b*) show specific examples of a circuit configuration of the fuel injection control apparatus.

In FIG. 2(*a*), a solenoid 16 composes the electrometric fuel injection pump 2. As driving means 14 to drive the solenoid 16, an N-channel FET 14 is used herein. Current detecting resistance 22 is connected to the source of the N-channel FET 14, and the driving current flows into the ground side through the current detecting resistance 22.

A driving circuit as illustrated in FIG. 2(*a*) has storage means for reusing the energy generated in halting the driving of the solenoid 16 without dissipating the heat. The storage means is provided with a capacitor 31 that temporarily stores the energy which is generated in halting the driving of the solenoid 16 and stored in the solenoid 16, a discharge control element 32 composed of a FET that controls the discharge of the capacitor 31, a current backflow preventing circuit 33 that prevents the voltage stored in the capacitor 31 from being provided to the power supply 11 side in applying the voltage to the solenoid 16, and a rectifying element 34 that prevents the current from directly flowing into the FET 14 from the capacitor 31 due to high voltage stored in the capacitor 31.

ON/OFF of the discharge control element 32 is controlled by a discharge control circuit provided in a microcomputer 13. In addition, the energy stored in the capacitor 31 may be used to charge the battery of the power supply. Further, a structure may be possible that absorbs the energy of the solenoid 16 by dissipating the heat by resistance or the like without being provided with the capacitor 31.

Figure 21:
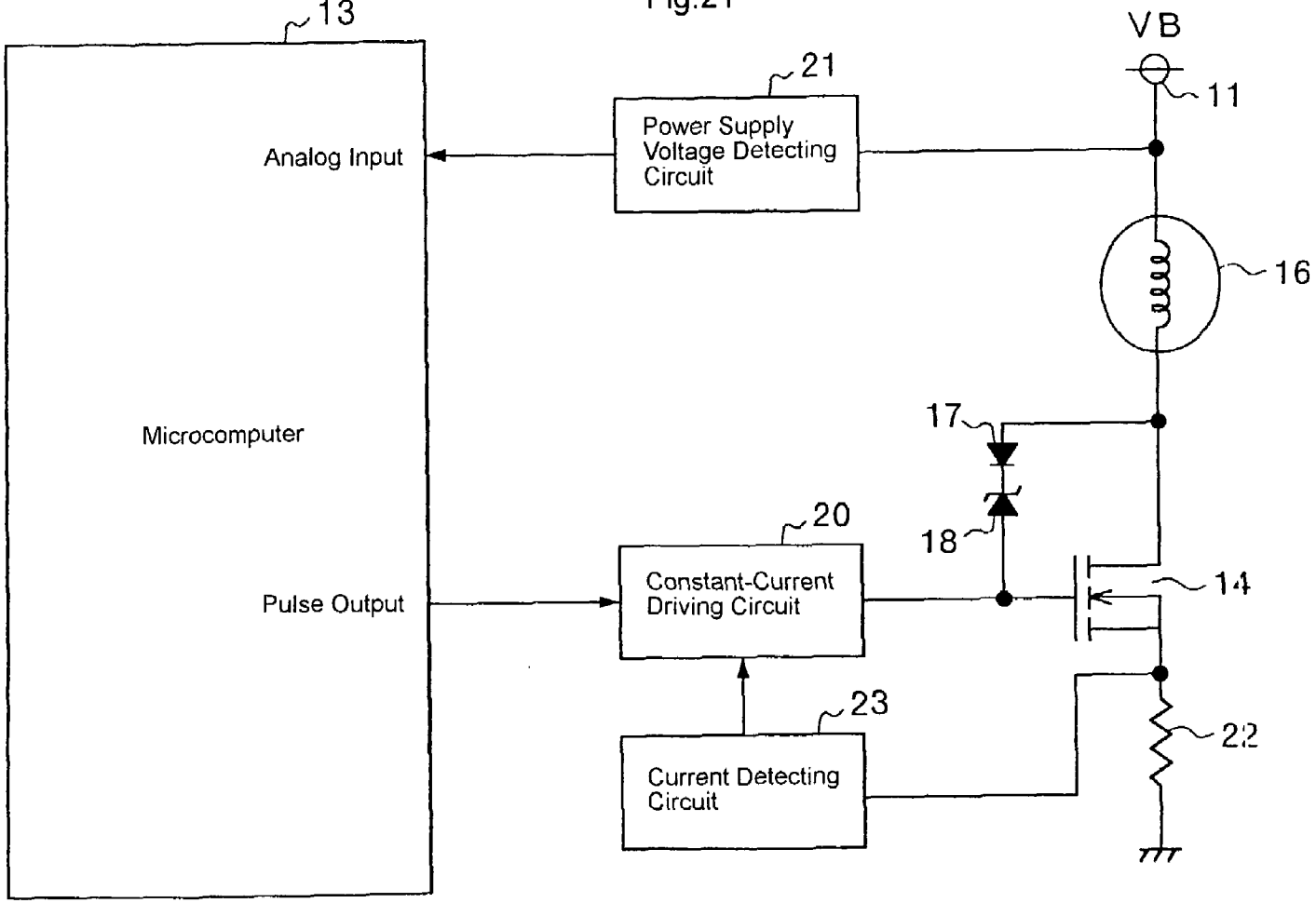
FIG. 21 illustrates a control mechanism of a conventional fuel injection apparatus that performs constant-current control.

The microcomputer 13 is included in the control unit 6. When detecting the power supply voltage VB as in FIG. 21, it may be possible that the power supply voltage VB is divided by resistance or the like, and that the divided voltage is supplied to the microcomputer 13.

The solenoid 16 is connected at one end to a power supply terminal 11 to which the power supply voltage VB is applied, while being connected at the other end to the drain of the FET 14. A driving pulse output from the microcomputer 13 is provided to the gate of the FET 14. The driving pulse is provided while having a pulse width corresponding to a required fuel injection amount in each fuel injection cycle.

As described above, the source of the FET 14 is grounded via the current detecting resistance 22. When the FET 14 becomes ON by the driving pulse P, the driving current (coil current) flows into a ground terminal via the solenoid 16, FET 14 and current detecting resistance 22, and the solenoid 16 is driven. The level of the current flowing through the current detecting resistance 22 is input to a current detecting circuit 23 as a voltage signal, and a current value corresponding to the input voltage is detected.

A detection signal output from the current detecting circuit 23 is input to the microcomputer 13, and converted into a digital signal in an A/D converter (not shown), and thus the processing for correcting the driving pulse is executed.

The current detecting circuit 23 is provided with a current integrator circuit 24 that integrates the current value to output, and a reset circuit 25. The current integrator circuit 24 has an operational amplifier 24*a* to which is input the voltage between opposite ends of the current detecting resistance 22, an integrator capacitor 24*b* inserted into a feedback loop of the operational amplifier 24*a*, and series resistance 24*c* connected to the current detecting resistance 22 and the feedback loop (in series with the integrator capacitor 24*b*) of the operational amplifier 24*a*. An output of the operational amplifier 24*a* is stored in the integrator capacitor 24*b*, and the stored value is output to the microcomputer 13 as the actual current integral D2.

The reset circuit 25 is comprised of a series circuit of an N-channel FET 25*a* and resistance 25*b* that is parallel-connected to the integrator capacitor 24*b*. At the time of reset, the microcomputer 13 causes the FET 25*a* to be ON using a reset signal K, thereby causing the energy stored in the integrator capacitor 24*b* to be consumed (discharged) by the resistance 25*b*, and thus clears the actual current integral D2. The reset process is performed for each fuel injection cycle, and in the present invention, is performed before driving is started in the fuel injection cycle.

FIG. 2(*b*) shows an example of the circuit configuration of the fuel injection control apparatus when the actual current integral is calculated in digital processing.

In the example of the circuit configuration, as in FIG. 2(*a*), the coil current flowing through the solenoid 16 is converted into a voltage value generated between opposite ends of the resistance 22 to measure. A voltage drop occurring in the resistance 22 is divided into resistance 26*a* and resistance 26*b* in the current detecting circuit 23, and the divided voltage is input to the non-inversion input of the operational amplifier 24*a*. A mutual connection point of resistance 26*c* and resistance 26*d* is input to the inversion input of the operational amplifier 24*a*. The other terminal of the resistance 26*c* is grounded, and the other terminal of the resistance 26 disconnected to the output of the operational amplifier 24*a*. The gain of the operational amplifier 24*a* is determined by the resistance 26*c* and resistance 26*d*.

An output of the operational amplifier 24*a* indicates a coil current value, is converted into a digital value in a digital converter (not shown), and is input to the microcomputer 13. The microcomputer reads a digitized coil current value Ic on a predetermined period T (for example, 10 microseconds) basis, stores the read coil current value of each period in a memory, and calculates the actual current integral of the coil current value.

Thus detection of the actual current integral by a digital circuit does not use a capacitor that stores the electrical charge unlike the analog circuit as shown in FIG. 2(*a*), thereby is capable of reducing detection errors caused by fluctuations in characteristics between elements, variations in temperature, and changes with time, and enables accurate detection of the actual current integral.

Figure 3:
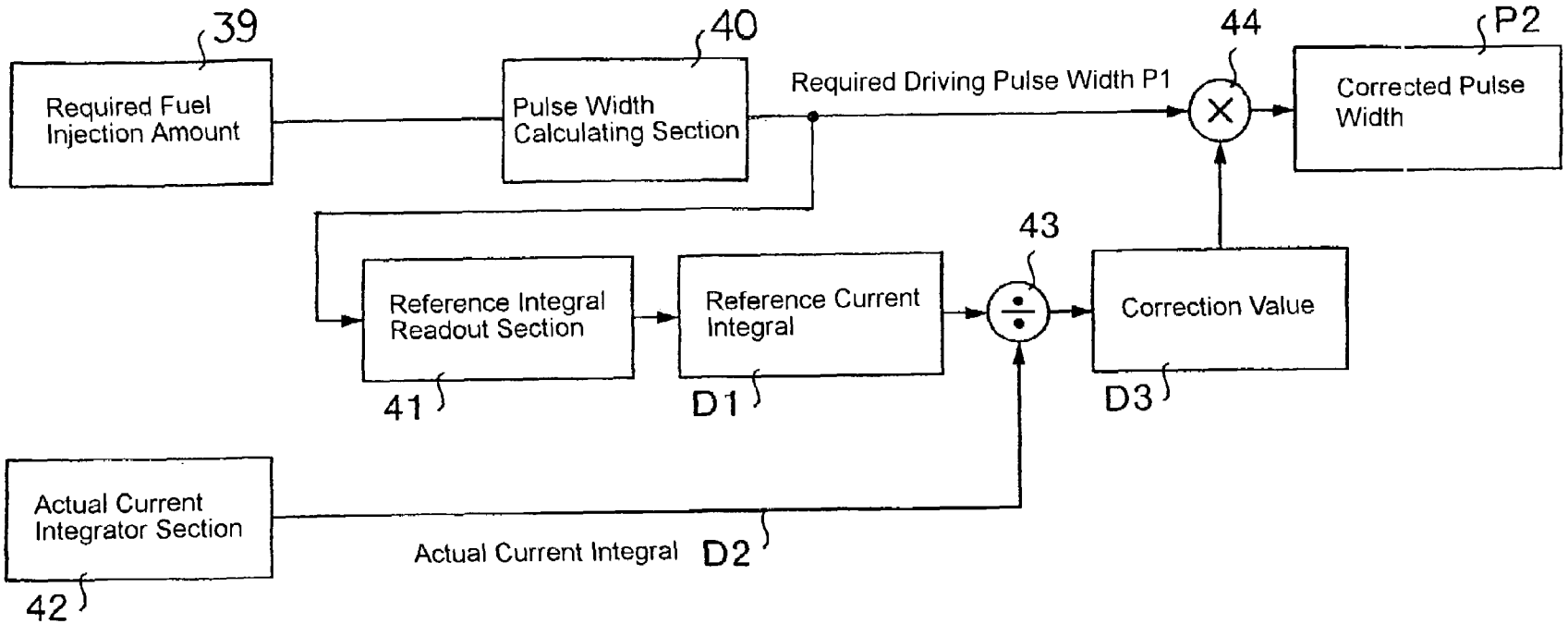
FIG. 3 is a block diagram illustrating a functional configuration according to a first embodiment of the present invention.

FIG. 3 is a block diagram illustrating a functional configuration to implement the fuel injection control method and apparatus according to the first embodiment. Each processing described in the block diagram is executed by the microcomputer 13 that composes the control means.

The engine side provides data of a required fuel injection amount 39 to the fuel injection control apparatus for each fuel injection cycle. The control apparatus has a pulse width calculating section 40 that calculates a driving pulse width (required driving pulse width) P1 corresponding to the required fuel injection amount, a reference integral readout section 41 that reads out a reference current integral D1 based on the required driving pulse width P1 by refereeing to a reference integral map, an actual current integrator section 42 that calculates the integral (actual current integral) D2 of the current obtained after starting driving the solenoid, a division section 43 that divides the reference current integral D1 by the actual current integral D2 to obtain a correction value D3, and a multiplication section 44 that multiplies the required driving pulse width P1 by the correction value D3 to obtain a corrected pulse width P2. In addition, the actual current integrator section 42 is composed of the current integrator circuit 24 as illustrated in FIG. 2(*a*) or FIG. 2(*b*).

Thus, the fuel injection control apparatus according to the first embodiment uses the division section 43 as the comparing means, and obtains a ratio of the reference current integral D1 to the actual current integral D2.

An example of processing processes by the fuel injection control method according to this embodiment will be described below with reference to the flowchart in FIG. 4 and the timing chart in FIG. 5.

Figure 4:
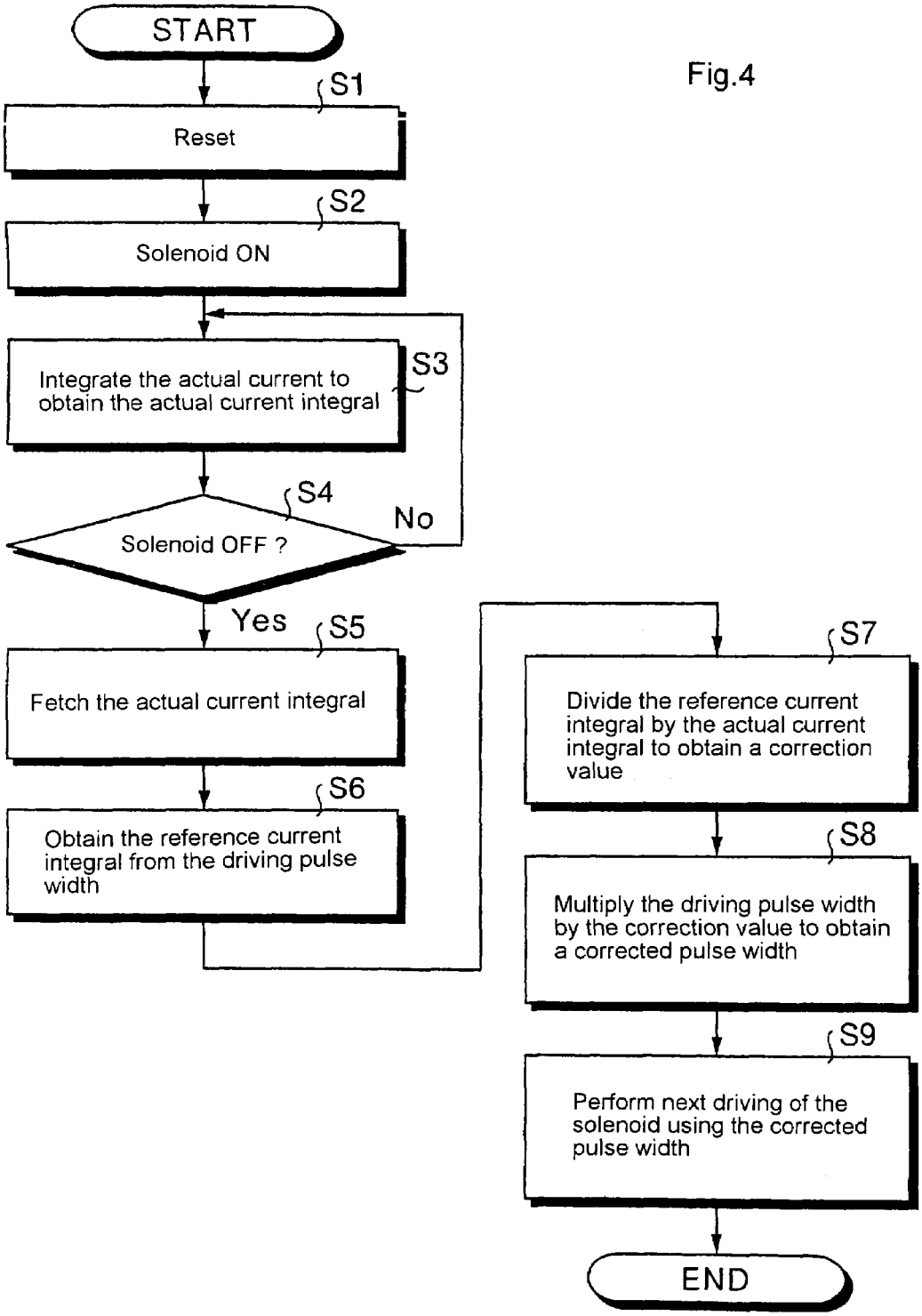
FIG. 4 shows a flowchart to explain the flow of control processing in the first embodiment.
Figure 5:
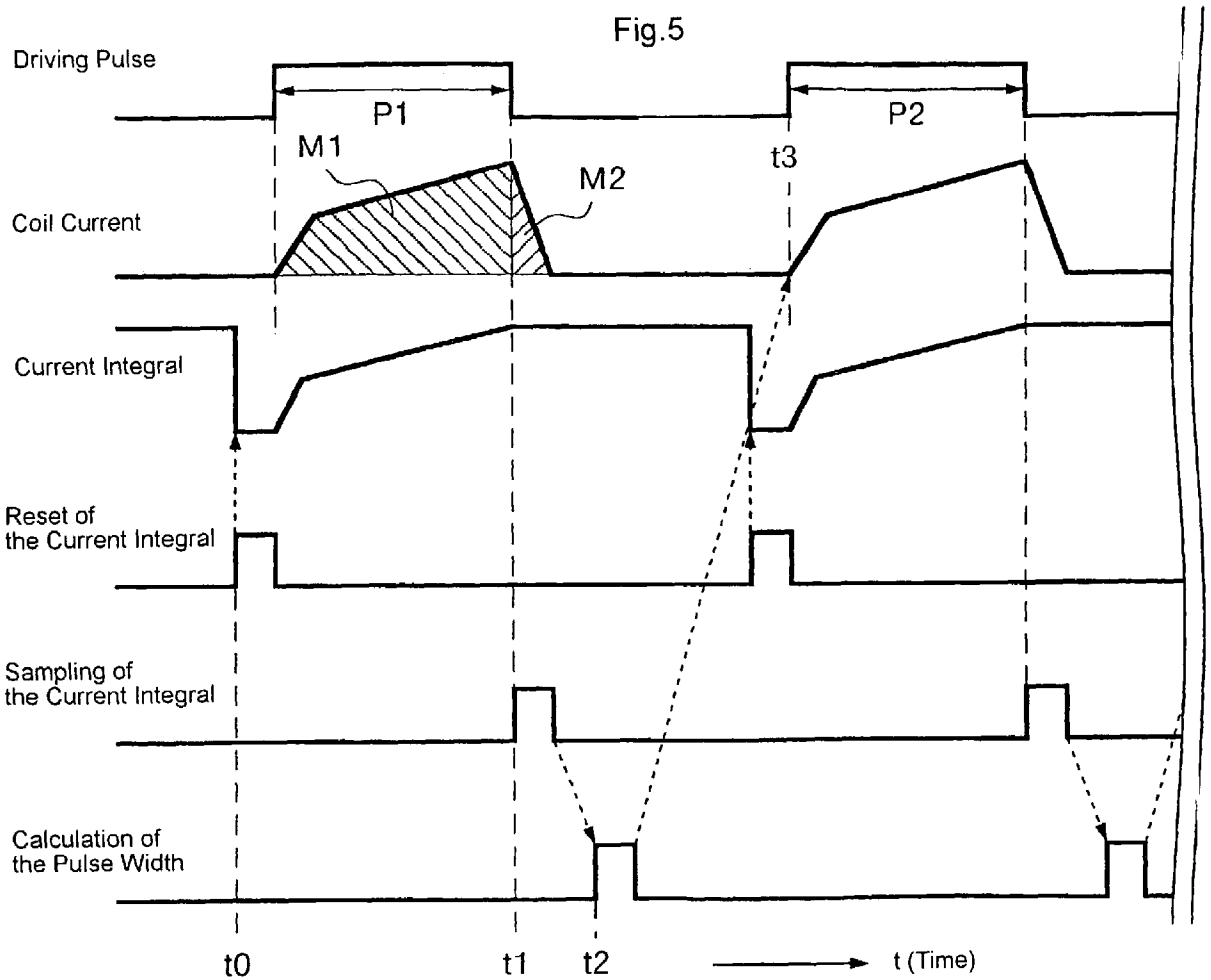
FIG. 5 shows a timing chart to explain the flow of control processing in the first embodiment.

In FIG. 4, the reset signal K is output before the electromagnetic fuel injection pump 2 stars the fuel injection (step S1, "t0" on the time axis in FIG. 5). In this way, the FET 25*a* is ON for a certain time, which discharges the integrator capacitor 24*b* and resets the actual current integral D2.

The microcomputer 13 outputs a driving signal with the driving pulse width P1 corresponding to the required fuel injection amount (required injection amount), thereby causes the FET 14 to be ON, and starts driving the solenoid 16 of the electromagnetic fuel injection pump 2 (step S2). Then, the current integrator circuit 24 calculates the actual current integral D2 of a coil current that has flowed since the solenoid is driven (step S3).

When the fuel injection solenoid 16 is switched from ON (step S4:No) to OFF (step S4:Yes), the microcomputer 13 fetches the actual current integral D2 up to this point (step S5, "t1" on the time axis in FIG. 5).

Then, the microcomputer 13 executes the pulse width calculation processing during a period (time "t2" in FIG. 5) before the driving is started in the next fuel injection cycle. First, the microcomputer 13 obtains the reference current integral D1 from the driving pulse width P1 using a reference current integral map set in advance (step S6).

Figure 6:
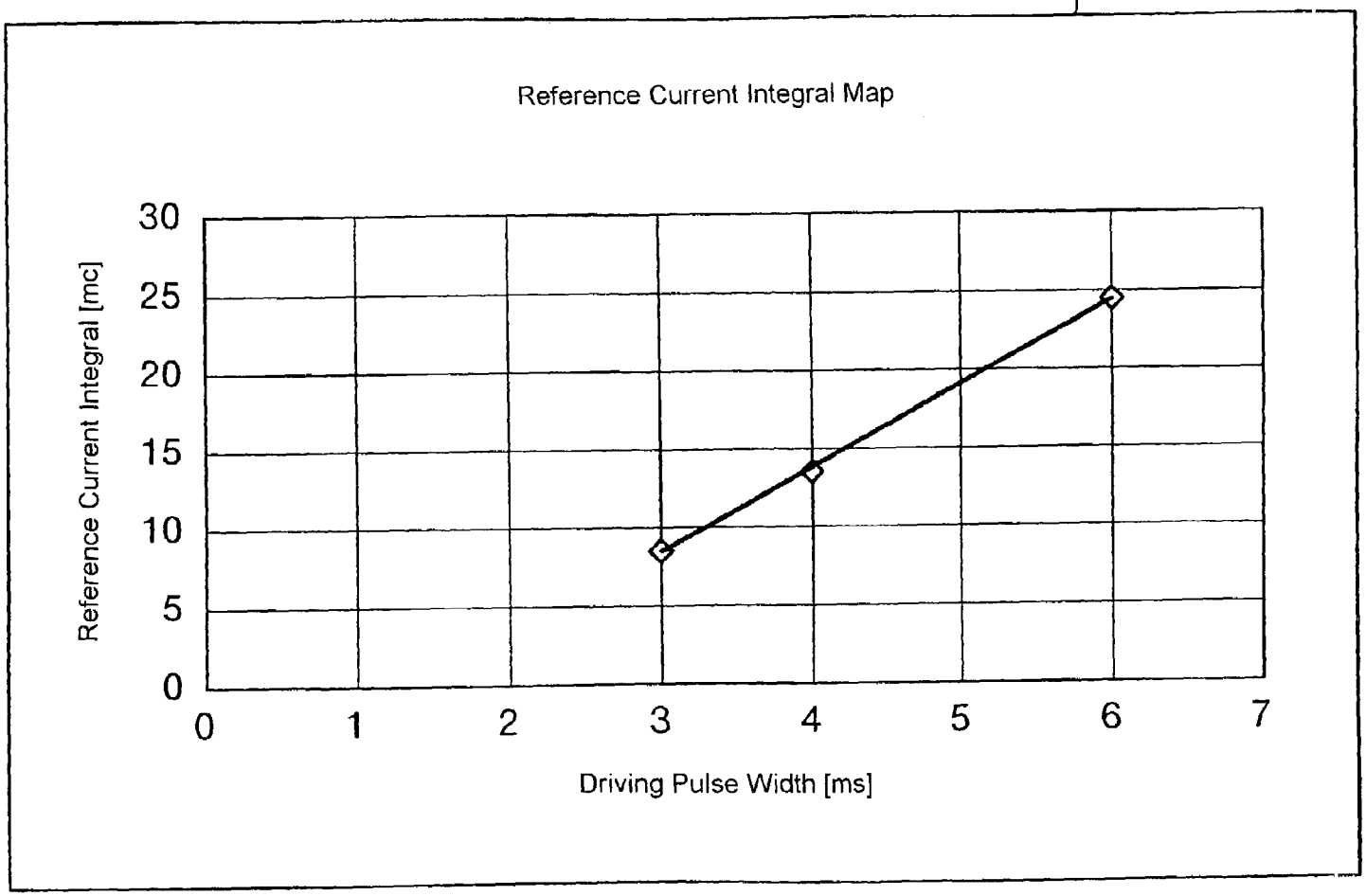
FIG. 6 shows an example of a reference current integral map.

FIG. 6 is an example of a graph showing a reference current integral map 50. As shown in FIG. 6, it is possible to represent the relation of the reference current integral D1 with the driving pulse width P1 as a specified characteristic line, and data in accordance with the characteristic line is stored in the memory in the microcomputer as the reference current integral map 50. The example of FIG. 6 shows a state where as the driving pulse width P1 increases, the reference current integral D1 increases with a predetermined coefficient.

Then, the obtained reference current integral D1 is divided by the actual current integral D2 fetched in step S5 and the correction value D3 is thereby obtained (step S7). The correction value D3 is multiplied by the driving pulse width P1 corresponding to the required fuel injection amount and the corrected pulse width P2 is thereby obtained (step S8). The corrected pulse width P2 is used as a corrected pulse width P2 for driving the solenoid 16 in the next fuel injection by the electromagnetic fuel injection pump 2 (step S9). The corrected pulse width P2 is stored in the memory (not shown) in the microcomputer 13, and is used as the driving pulse P for a period (fuel injection time) during which the FET 14 is ON in the next driving of the solenoid 16 (time "t3" in FIG. 5).

The actual current integral D2 as described above is an actual current integral of the coil current flowing through the solenoid 16 for a period during which the driving pulse width P1 is output, and corresponds to a region M1 in FIG. 5. Conditions for calculating the reference current integral D1 in the reference current integral map 50 in FIG. 6 are set in relation to a period during which the coil current flowing through the solenoid 16 reaches a peak value. The present invention is not limited to the foregoing, and allows a configuration where the reference current integral map is set for, as the reference current integral D1, the whole-area integral (region M1+M2 in FIG. 5) until the coil current flowing through the solenoid 16 reaches 0, while the actual current integral D2 also has the whole-area integral.

Figure 7:
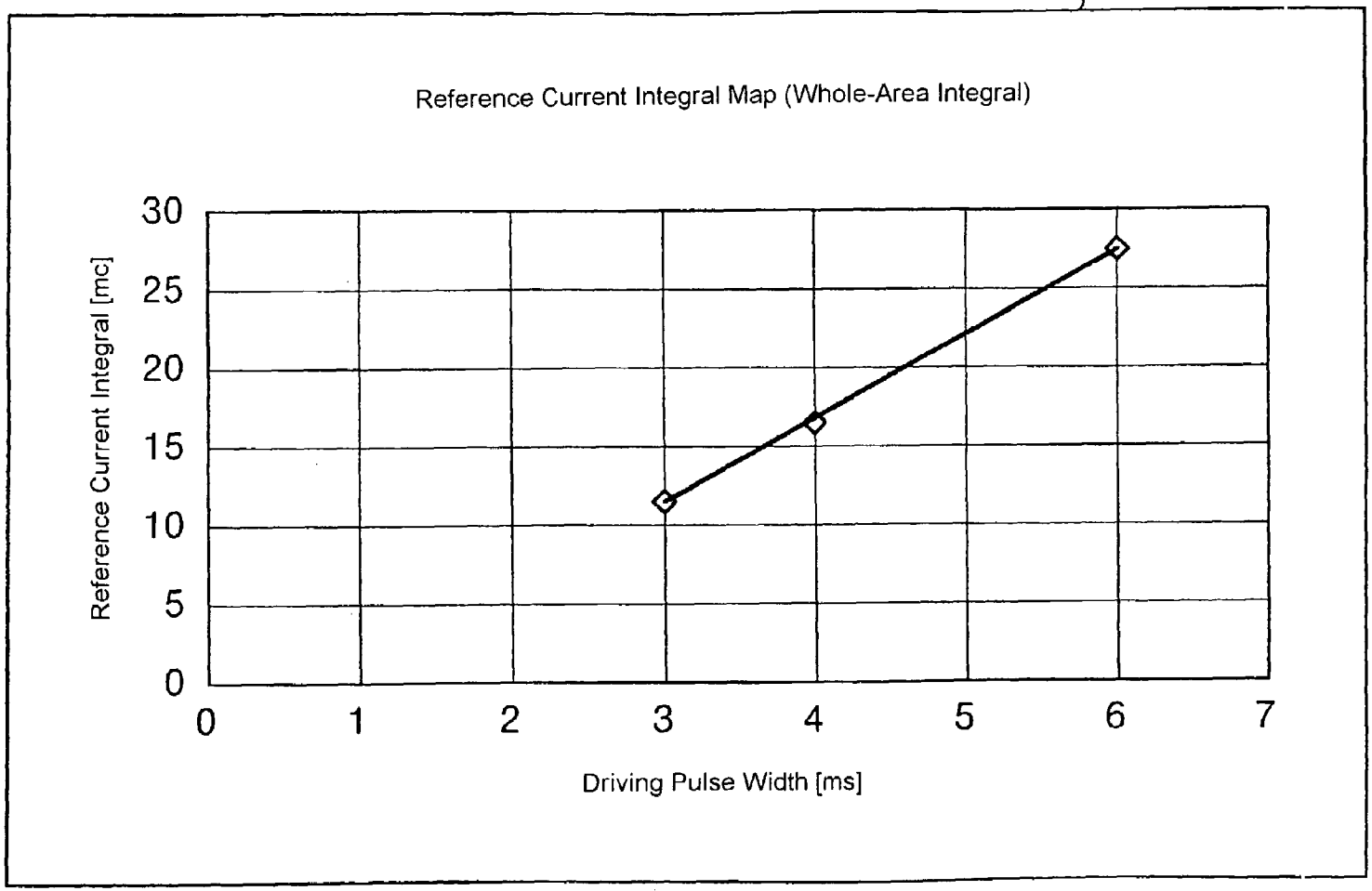
FIG. 7 shows an example of a reference current integral map used in whole-area integral.

FIG. 7 is a graph showing the reference current integral map 50 used in the whole-area integral as described above.

Thus, according to the first embodiment, it is possible to correct the driving pulse width P1 using the calculated actual current integral D2, and the microcomputer 13 is capable of fetching the actual current integral D2 during a period of time the solenoid 16 is OFF, i.e., the fuel injection is halted, with a margin for time, thus overcoming restrictions on timing for fetching the integral. Further, the power supply to the solenoid 16 is stored and supplied, it is thereby possible to supply stable power supply voltage, and effects (temporal effects) of sampling time are not imposed. Therefore, it is possible to detect the power supply voltage stably and to improve the accuracy in correcting the driving pulse P.

A modification of the first embodiment will be described below.

As described above specifically, in the first embodiment, a pulse width of a driving signal for a next fuel injection cycle is corrected, based on the actual current integral of the coil current that flows during a period of time the driving of the solenoid is started and then halted. As a modification of the first embodiment, it is possible that the actual current integral of the coil current flowing after driving the solenoid is detected at real time, and based on the real-time value, the timing is corrected and adjusted for halting the driving of the solenoid in the relevant fuel injection cycle.

Figure 8:
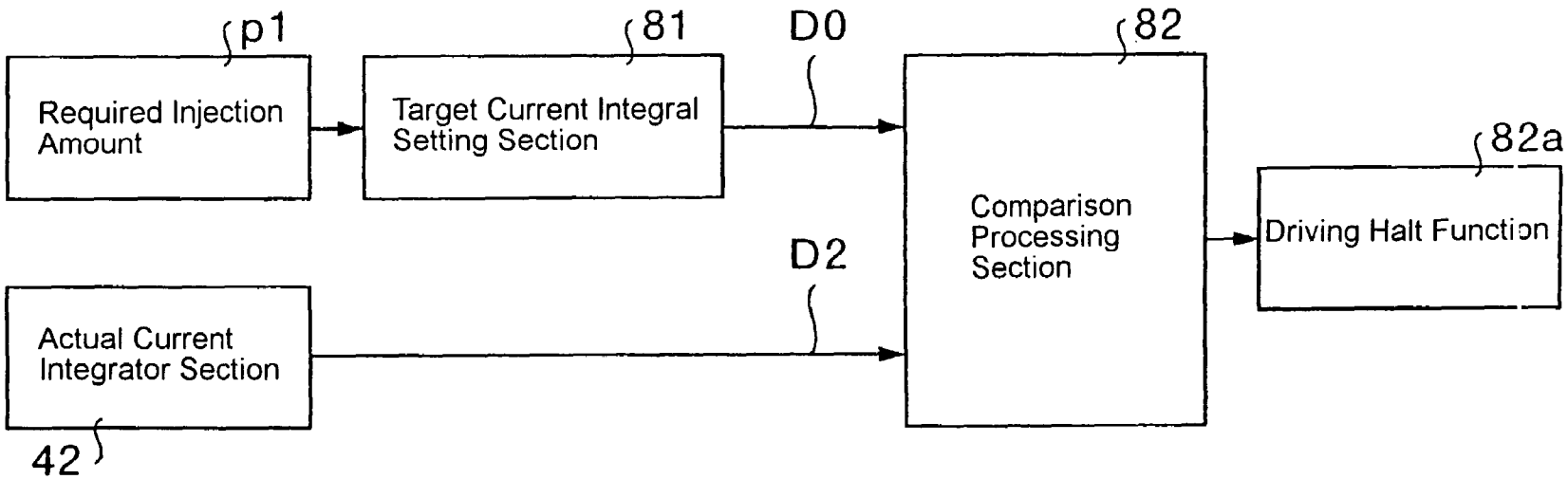
FIG. 8 is a block diagram illustrating a functional configuration of a modification of the first embodiment.

FIG. 8 illustrates a block diagram of a functional configuration for implementing the modification according to the first embodiment. In FIG. 8, the control unit 6 (FIG. 1) is comprised of the microcomputer 13, and has each functional section as illustrated in the figure. A required injection amount p1 necessary for the present fuel injection is input to a target current integral setting section 81, and the section 81 outputs a target current integral D0 corresponding to the required injection amount p1 to a comparison processing section 82.

At the same time, the actual current integrator section 42 calculates the integral (actual current integral) D2 of the current obtained after starting driving the solenoid 16 to output to the comparison processing section 82. A specific circuit configuration composing the actual current integrator section 42 will be described later in detail. The comparison processing section 82 compares integrals to determine whether or not the actual current integral reaches the target current integral, and has a driving halt function 82*a* that halts the output of the driving pulse P for the solenoid 16 concurrently with the time the actual current integral reaches the target current integral.

Figure 9:
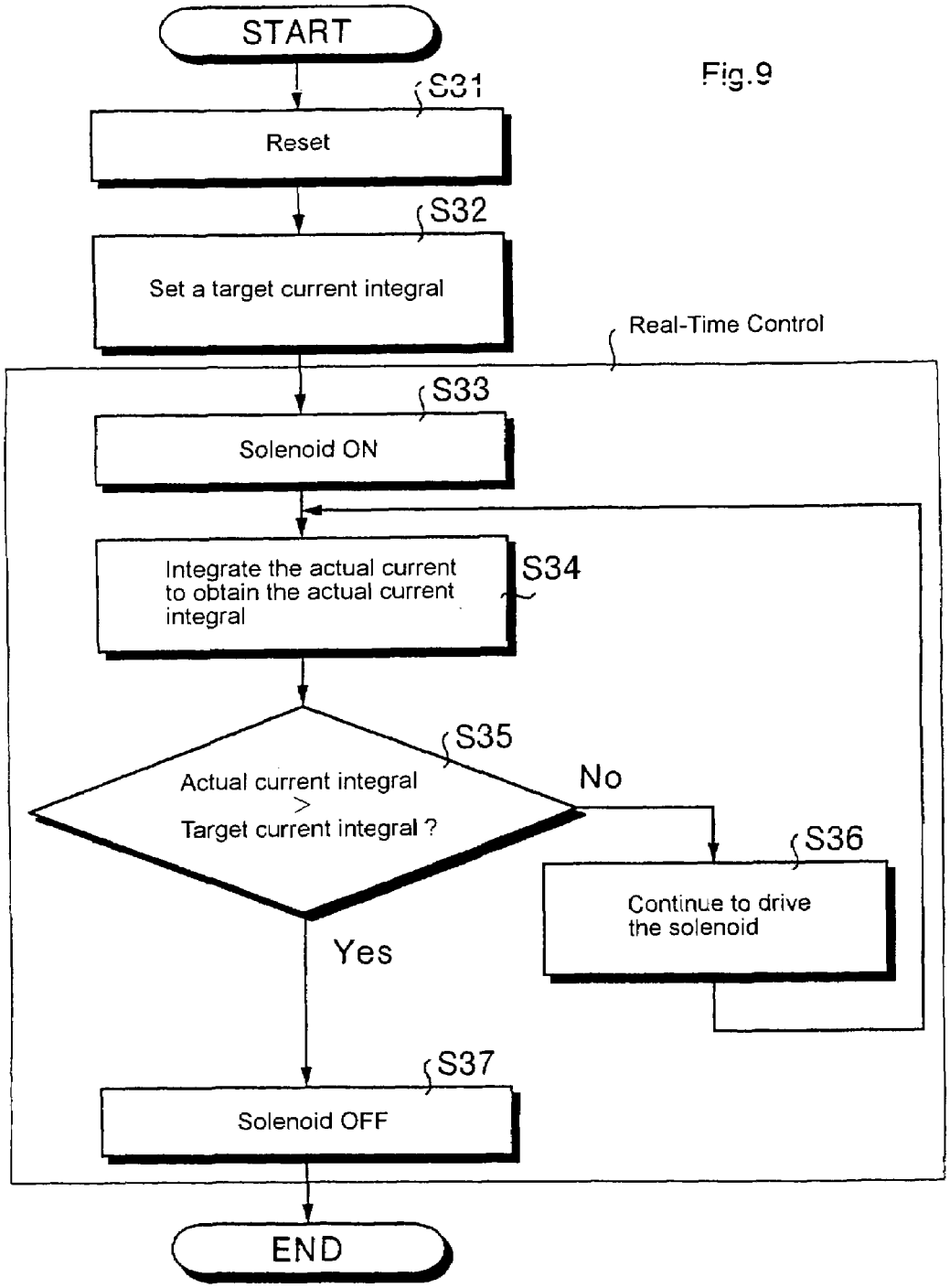
FIG. 9 shows a flowchart to explain the flow of control processing in the modification of the first embodiment.

A control process in the modification according to the first embodiment will be described below based on the flowchart in FIG. 9 and the timing chart in FIG. 10.

Figure 10:
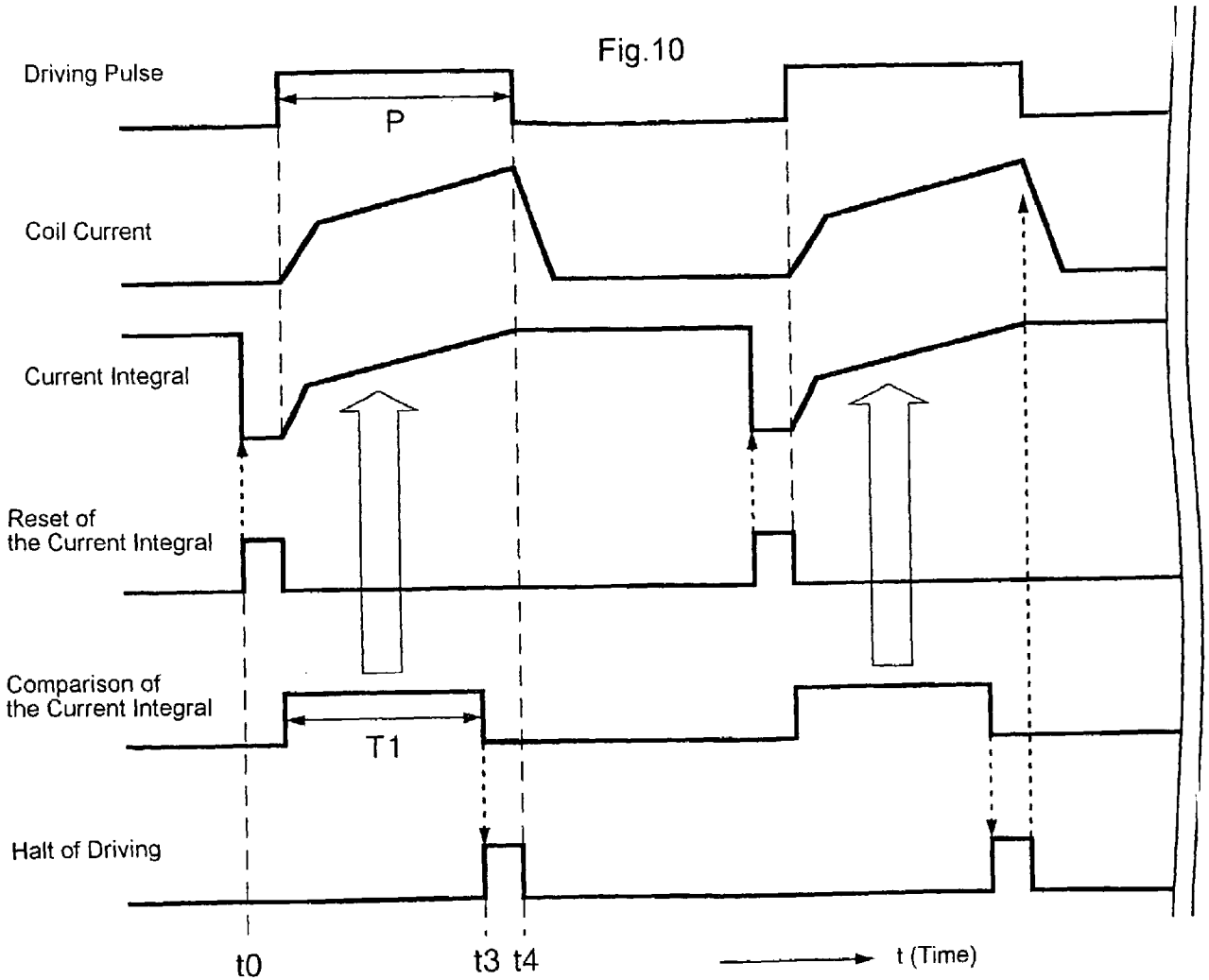
FIG. 10 shows a timing chart to explain the flow of control processing in the modification of the first embodiment.

The reset signal K is output before the electromagnetic fuel injection pump 2 stars the fuel injection (step S31, time "t0" in FIG. 10). In this way, the FET 25*a* is ON for a certain time, which discharges the integrator capacitor 24*b* and resets the actual current integral D2.

The microcomputer 13 is set for the target current integral D0 corresponding to the required injection amount p1 (step S32), provides the driving pulse P to the FET 14 to cause the FET 14 to be ON, and starts driving the solenoid 16 of the electromagnetic fuel injection pump 2 (step S33).

Then, the current integrator circuit 24 calculates the actual current integral D2 of the coil current that has flowed since the solenoid 16 is driven (step S34). A comparer 80 compares the actual current integral D2 with the target current integral D0 (step S35). FIG. 10 shows a comparison processing term T1 where the comparer 80 compares the current integrals. During a period of time the actual current integral D2 is smaller than the target current integral D0 (step S35: No), the driving pulse P is continuously output (for driving the solenoid 16) to the FET 14 (step S36).

Meanwhile, when the actual current integral D2 is larger than the target current integral D0 (time "t3" in FIG. 10, step S35: Yes), the output of the driving pulse P (for driving the solenoid 16) is halted to the FET 14 (time "t4" in FIG. 10, step S37).

In this way, the real-time processing is implemented for substantially correcting a driving pulse width in the present fuel injection cycle using the actual current integral, and it is thereby possible to achieve the prompt fuel injection control with high accuracy without restrictions on processing timing.

Thus, according to the present invention, the driving control of a solenoid for fuel injection is performed based on the actual current integral of the coil current flowing through the solenoid. This is based on findings that the actual current integral of the solenoid 16 has a strong correspondence with the fuel injection amount.

Figure 11:
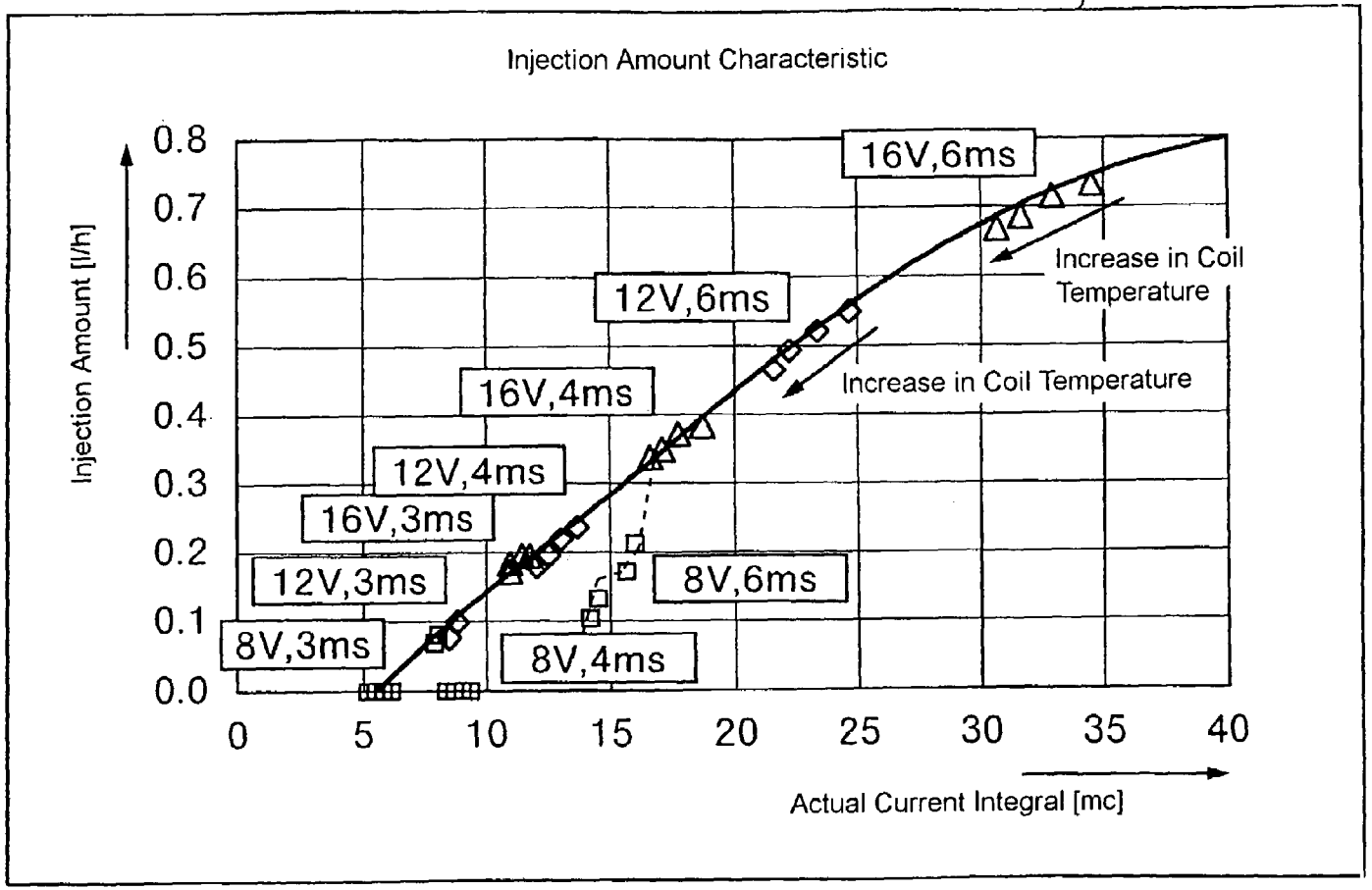
FIG. 11 shows an example of a fuel injection amount characteristic view indicative of a correspondence between an actual current integral and a fuel injection amount.

FIG. 11 shows the injection amount characteristic to explain the correspondence between the current integral and the fuel injection amount. As shown in FIG. 11, irrespective of variations in power supply voltage and in driving pulse width, it is clearly indicated that the actual current integral and the fuel injection amount have the unique relationship.

Thus, even when an external factor such as a variation occurs in power supply voltage to supply to the solenoid 16 and in coil temperature, such a factor only causes a shift on the characteristic line and does not have the effect on the injection amount characteristic. In this way, the correction for the fuel injection using the current integral according to the present invention enables the fuel injection control with effectiveness and with high accuracy.

Second Embodiment

In the second embodiment, the actual current integral of the coil current flowing through the solenoid is compared with a target current integral beforehand set in relation to a required fuel injection amount, and based on the comparison between the actual current integral and the target current integral, a driving pulse width for the solenoid is corrected to control the driving of the solenoid.

Accordingly, in the second embodiment, as a subject of comparison with the actual integral, "a reference current integral beforehand set in relation to a driving pulse width corresponding to a required fuel injection amount" in the first embodiment is replaced with "a target current integral beforehand set in relation to a required fuel injection amount".

Figure 12:
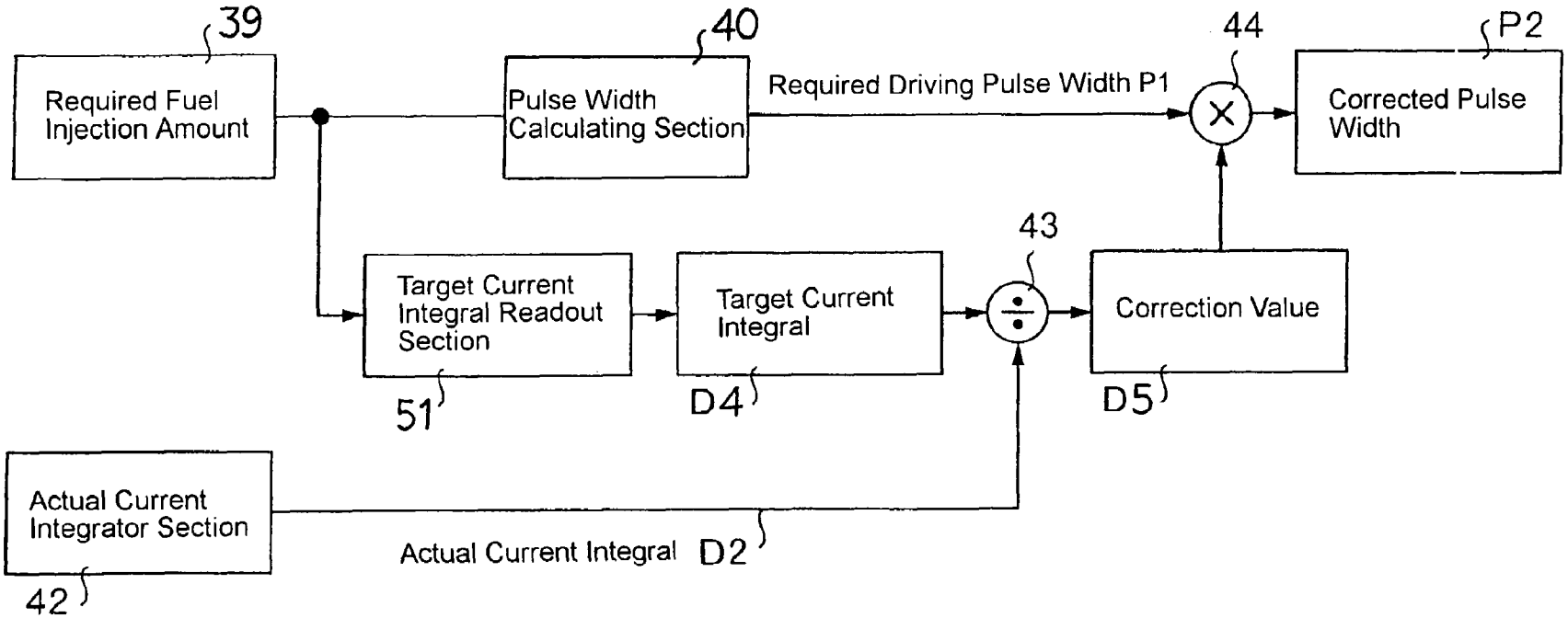
FIG. 12 is a block diagram illustrating a functional configuration according to a second of the present invention.

FIG. 12 is a block diagram illustrating a functional configuration to implement a fuel injection control method and apparatus according to the second embodiment. Each processing described in the block diagram is executed by the microcomputer 13 that composes the control means.

The engine side provides data of the required fuel injection amount 39 to the fuel injection control apparatus for each fuel injection cycle. The control apparatus has the pulse width calculating section 40 that calculates the driving pulse width (required driving pulse width) P1 corresponding to the required fuel injection amount, a target current integral readout section 51 that reads out a target current integral D4 in relation to the required fuel injection amount by refereeing to a target current integral map, the actual current integrator section 42 that calculates the integral (actual current integral) D2 of the current obtained after starting driving the solenoid, the division section 43 that divides the target current integral D4 by the actual current integral D2 to obtain a correction value D5, and the multiplication section 44 that multiplies the required driving pulse width P1 by the correction value D5 to obtain a corrected pulse width P2. In addition, the actual current integrator section 42 is composed of the current integrator circuit 24 as illustrated in FIG. 2(*a*) or FIG. 2(*b*).

Thus, the fuel injection control apparatus according to the second embodiment uses the division section 43 as the comparing means, and obtains a ratio of the target current integral D4 corresponding to the required fuel injection amount to the actual current integral D2.

Figure 13:
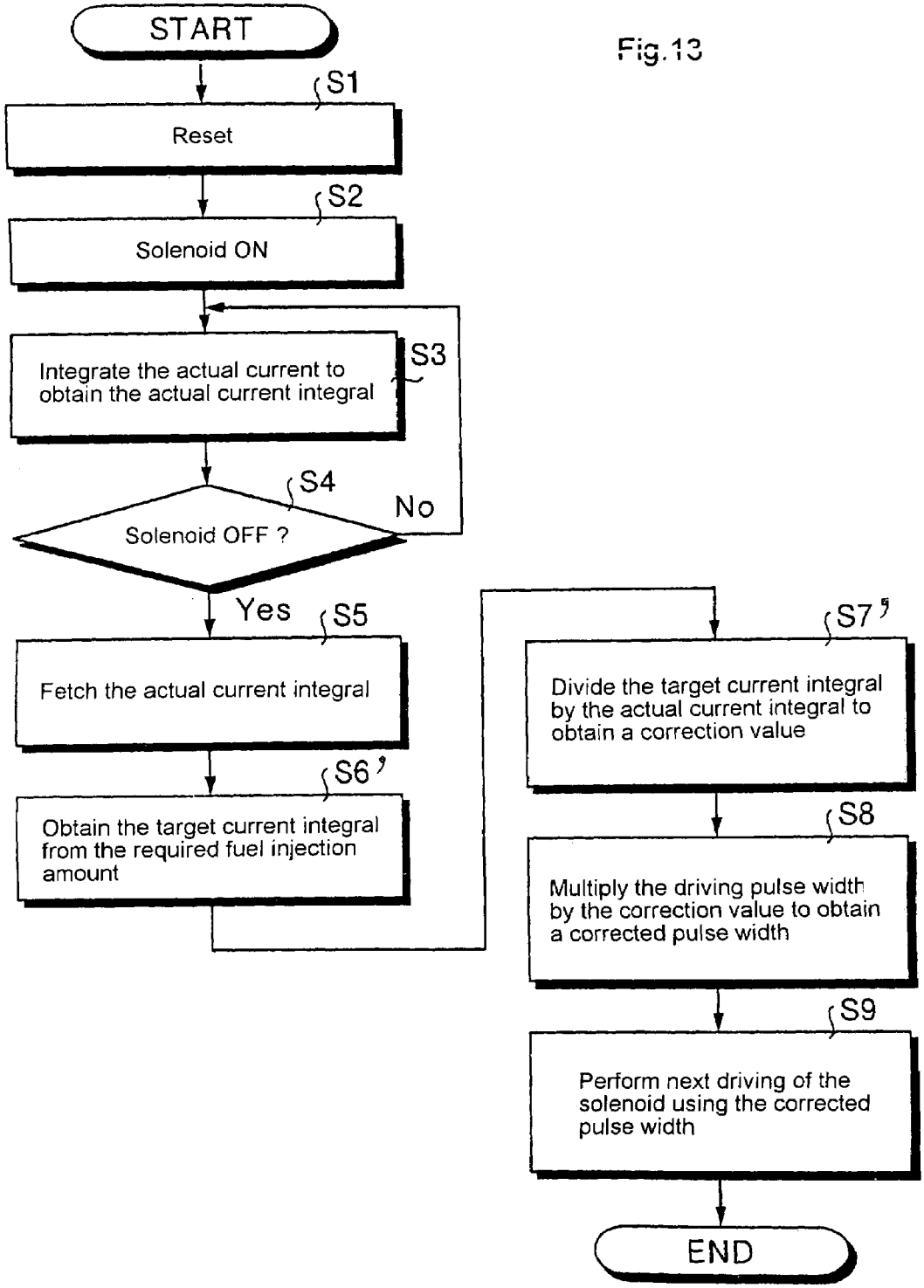
FIG. 13 shows a flowchart to explain the flow of control processing in the second embodiment.

FIG. 13 shows a flowchart of the processing processes by the fuel injection control method according to the second embodiment. The flowchart is the same as the flowchart of the processing processes according to the first embodiment as shown in FIG. 4 except that the processing for "obtaining the reference current integral from the driving pulse width" in step S6 in FIG. 4 is replaced with processing for "obtaining the target current integral from the required fuel injection amount" (step S6'), and that the processing for "dividing the reference current integral by the actual current integral to obtain the correction value (for the driving pulse width)" in step S7 in FIG. 4 is replaced with processing for "dividing the target current integral by the actual current integral to obtain the correction value (for the driving pulse width)" (step S7').

Accordingly, the target current integral beforehand set in relation to the required fuel injection amount is stored in the memory of the microcomputer.

As a modification of the second embodiment, as in the modification of the first embodiment, it is possible that the actual current integral of the coil current flowing after driving the solenoid is detected at real time, and the driving of the solenoid is halted at the time the real-time value reaches the target current integral read from the memory.

Third Embodiment

In the third embodiment, the required fuel injection amount is compared with an estimated fuel injection amount corresponding to the actual current integral of the coil current flowing the solenoid, a driving pulse width for the solenoid is corrected based on the comparison between the estimated fuel injection amount and the required fuel injection amount, and the driving of the solenoid is controlled based on the corrected driving pulse width.

Also in the third embodiment, the control circuit as illustrated in either FIG. 2(*a*) or FIG. 2(*b*) is used. Herein, the feedback control is executed for calculating a correction value, and such feedback control is performed that causes an estimated injection amount obtained based on the actual current integral to converge to the target injection amount.

Figure 14:
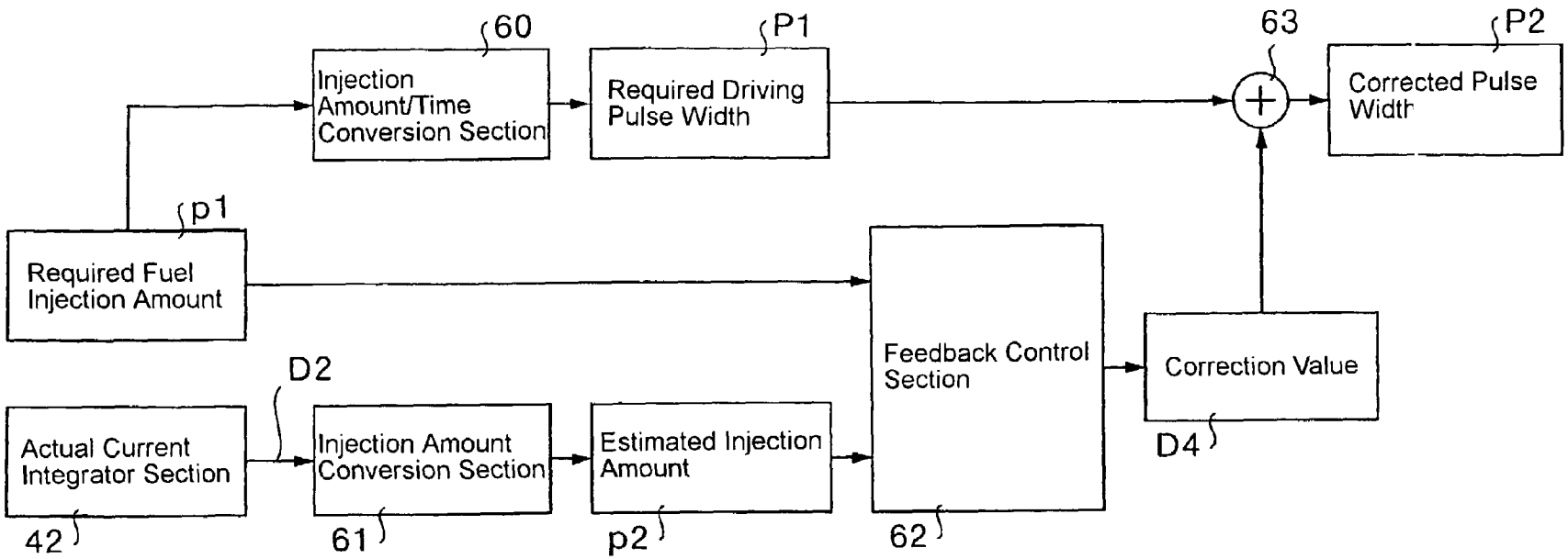
FIG. 14 is a block diagram illustrating a functional configuration according to a third embodiment of the present invention.

FIG. 14 is a block diagram illustrating a functional configuration to implement a fuel injection control method and apparatus according to the third embodiment. The control unit 6 (refer to FIG. 1) is comprised of the microcomputer 13 and has each functional section as illustrated in the figure.

The control apparatus has an injection amount/time conversion section 60 that obtains the driving pulse width (required driving pulse width) P1 corresponding to the required injection amount p1 in the present fuel injection, the actual current integrator section 42 that calculates the integral (actual current integral) D2 of the current obtained after starting driving the solenoid 16, an injection amount conversion section 61 that obtains an estimated injection amount p2 based on the actual current integral D2 using an injection amount conversion map, a feedback control section 62 that calculates a difference between the required injection amount p1 and the estimated injection amount p2 and obtains a predetermined correction value D4 for the injection amount, and an addition section 63 that adds the correction value D4 to the required driving pulse width P1 to obtain a corrected pulse width P2. In addition, the actual current integrator section 42 is composed of the current integrator circuit 24 as illustrated in FIG. 2(*a*) or FIG. 2(*b*).

Figure 15:
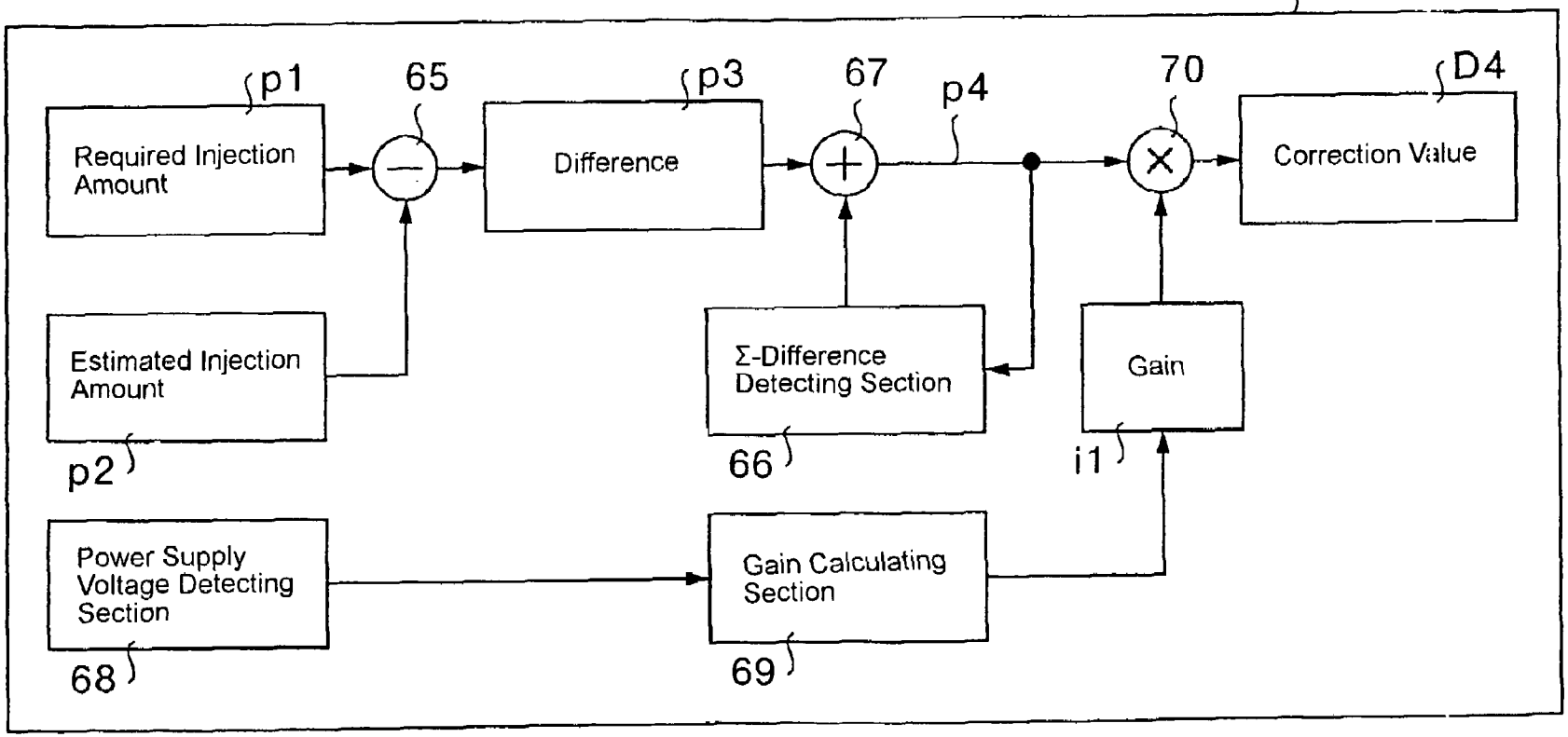
FIG. 15 illustrates an internal configuration of a feedback control section in the configuration as illustrated in FIG. 14.

FIG. 15 is a block diagram illustrating an internal configuration of the feedback control section 62. The feedback control section 62 performs the control operation based on P1 control with the integrator operation added to the proportional operation.

The section 62 is comprised of a subtraction section 65 that detects a difference between the required injection amount p1 and estimated injection amount p2 to output a difference p3, a Σ-difference detecting section 66 that detects the integral pΣ of the difference, an addition section 67 that outputs (p3+pΣ) obtained by adding the detected difference p3 and the integral pΣ of the difference, a power supply voltage detecting section 68 that detects the power supply voltage to supply to the solenoid 16 after driving the solenoid 16, a gain calculating section 69 that obtains a coefficient (gain) i1 corresponding to the detected power supply voltage by referring to the gain map, and a multiplication section 70 that multiplies the integral p4 (p4=p3+pΣ) of the difference output from the addition section 67 by the gain i1 to calculate the correction value D4 for the injection amount.

Figure 16:
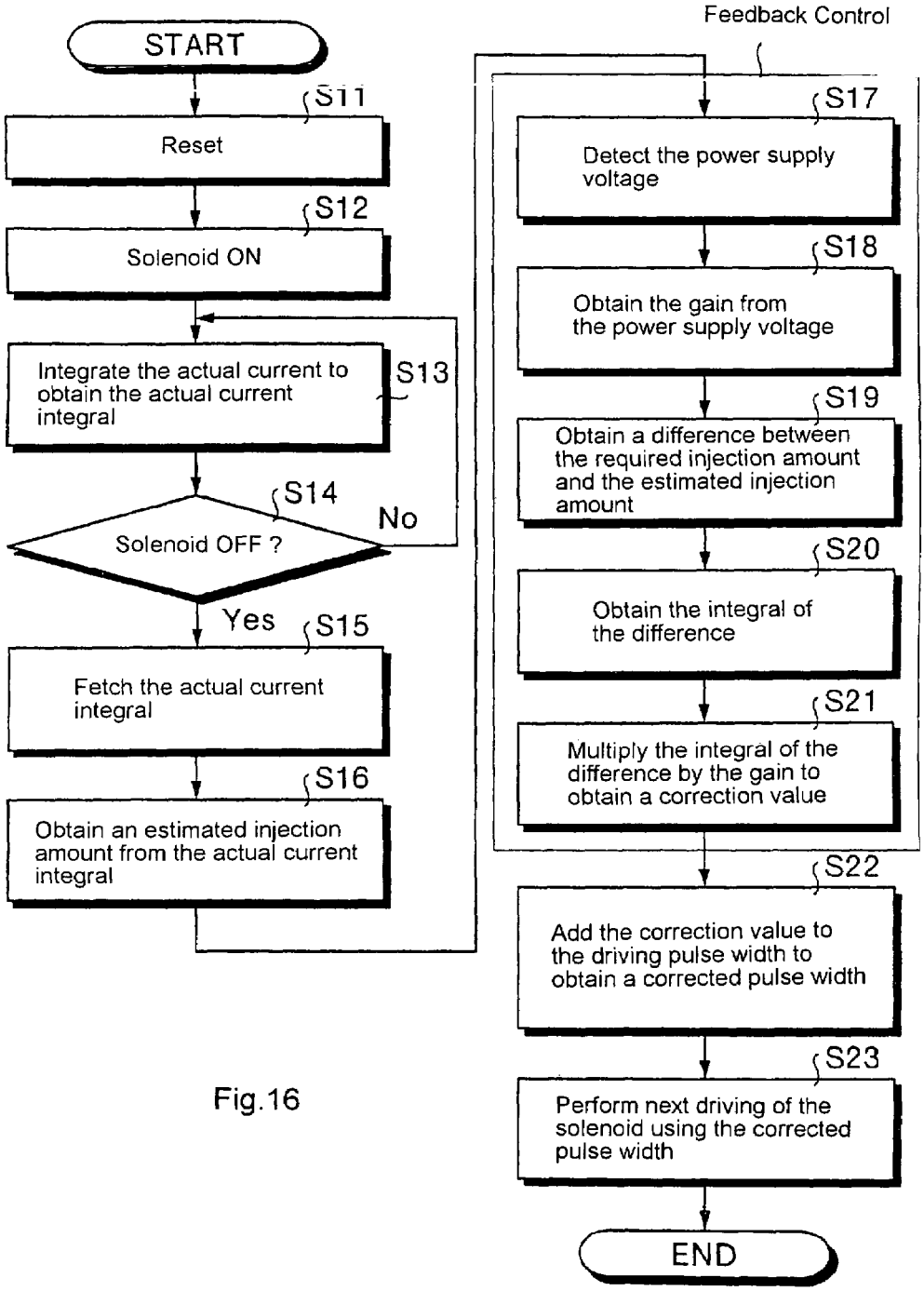
FIG. 16 shows a flowchart to explain the flow of control processing in the third embodiment.

FIG. 16 shows a flowchart of control processing in the third embodiment. The timing chart in the third embodiment is explained using FIG. 5 as in the first embodiment. First, the reset signal K is output before the electromagnetic fuel injection pump 2 stars the fuel injection (step S11, time "t0" in FIG. 5). In this way, the FET 25*a* is ON for a certain time, which discharges the integrator capacitor 24*b* and resets the actual current integral D2.

The microcomputer 13 uses the driving pulse width P1 corresponding to the required injection amount p1 to cause the FET 14 to be ON, and starts driving the solenoid 16 of the electromagnetic fuel injection pump 2 (step S12). Then, the current integrator circuit 24 calculates the actual current integral D2 of the coil current that has flowed since the solenoid 16 is driven (step S13).

When the solenoid 16 is switched from ON (step S4:No) due to the fuel injection to OFF (step S4:Yes), the microcomputer 13 fetches the actual current integral D2 up to this point (step S15, time "t1" in FIG. 5).

Figure 17:
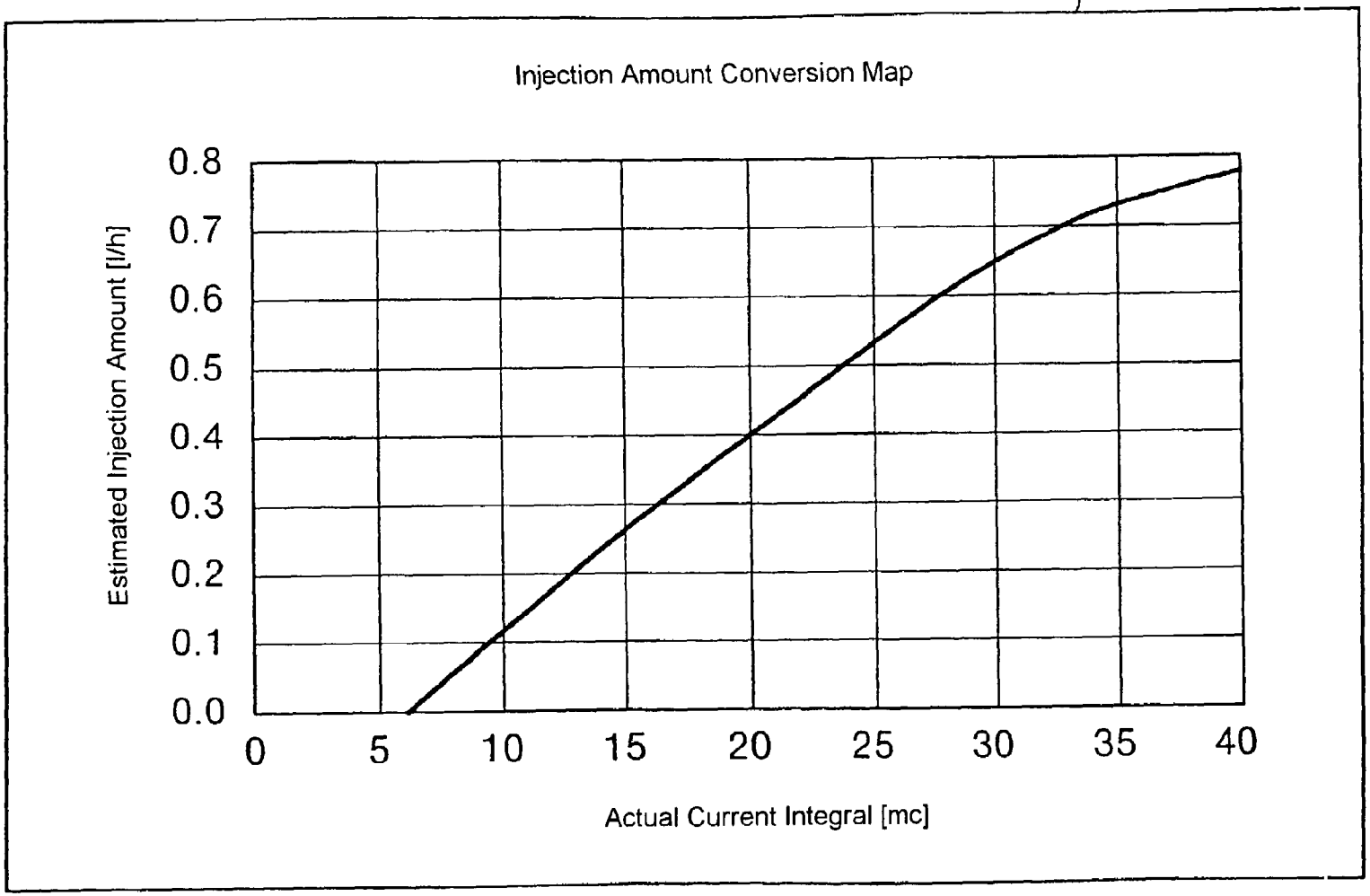
FIG. 17 shows an example of an injection amount conversion map.

Then, the microcomputer 13 executes the pulse width calculation processing as described below for a period (time "t2" in FIG. 5) before the next fuel injection is started. First, the microcomputer 13 obtains the estimated injection amount p2 from the read actual current integral D2 using an injection amount conversion map set in advance (step S16). FIG. 17 is a graph showing an injection amount conversion map 75. As shown in the figure, it is possible to represent the relation of the estimated injection amount p2 with the actual current integral D2 as a specified characteristic line, and data in accordance with the characteristic line is stored in the injection amount conversion map 75. The example of FIG. 17 shows a state where as the actual current integral D2 increases, the estimated injection amount p2 proportionally increases with a predetermined coefficient, while an increase rate of the estimated injection amount p2 decreases gradually when the actual current integral D2 is a predetermined value or more.

Then, the feedback control section 62 executes the feedback control as described below. The section 62 detects the power supply voltage to supply to the solenoid 16 (step S17), and using a gain map, obtains a predetermined gain i1 corresponding to the detected voltage (step S18).

Figure 18:
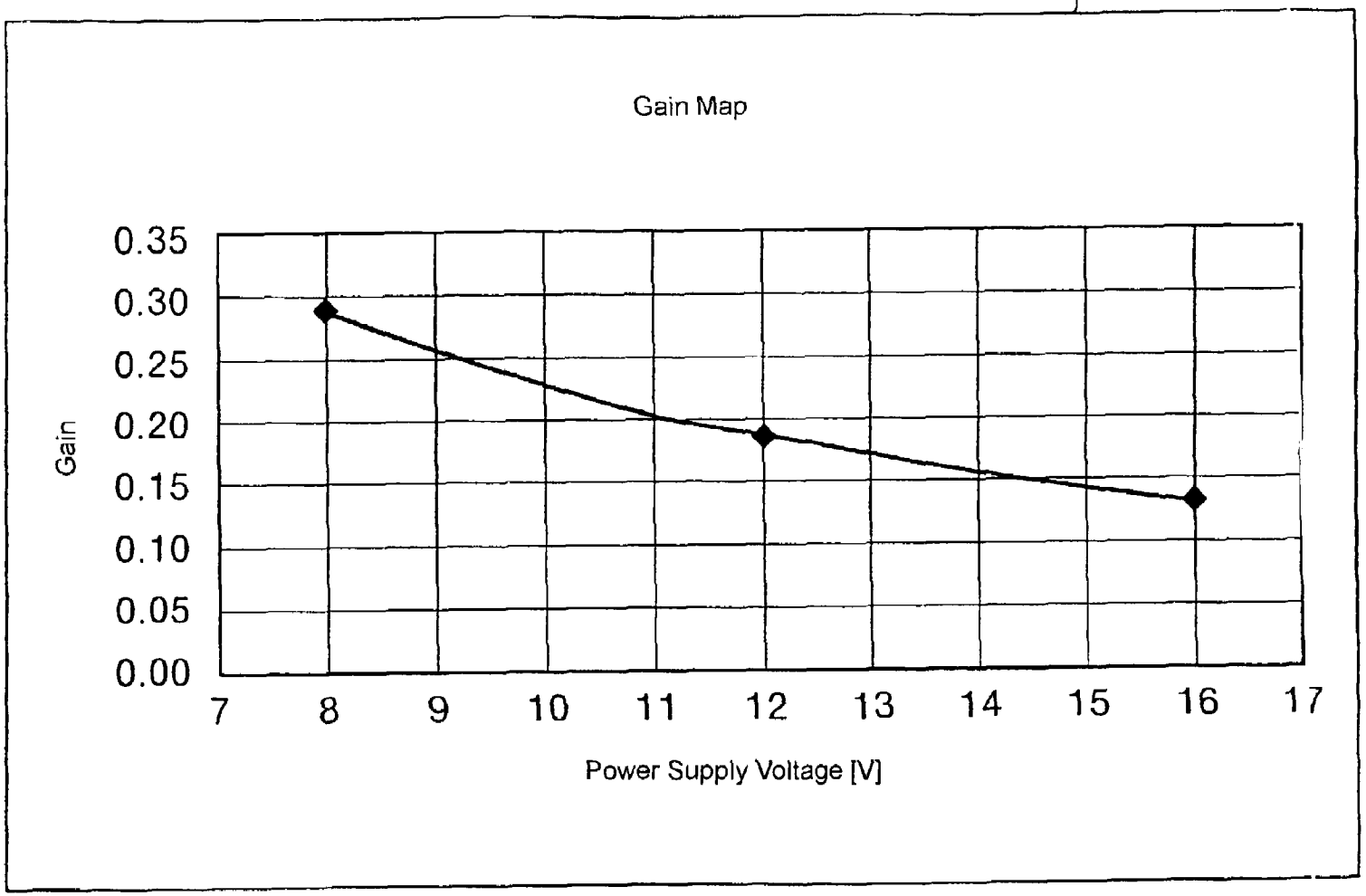
FIG. 18 shows an example of a gain map.

FIG. 18 is a graph showing a gain map 77. As shown in the figure, it is possible to represent the relationship between the power supply voltage and gain as a specified characteristic line, and data in accordance with the characteristic line is stored in advance in the gain map 77. In the example of FIG. 18, a value of the gain i1 decreases with increases in value of the power supply voltage, where the value of the gain i1 changes relatively largely in a range such that the power supply voltage is low, while changes in value of the gain i1 are small in a range such that the power supply voltage is relatively high.

Concurrently with the calculation of the gain i1, the feedback control section 62 calculates a difference p3 between the required injection amount p1 and estimated injection amount p2 (step S19), and obtains the integral p4 of the difference p3 (step S20). Then, the section 62 multiplies the integral p4 of the difference by the gain i1 to obtain the correction value D4 (step S21). Thus, the aforementioned feedback control is carried out in the feedback control section 62.

The corrected pulse width P2 is obtained by adding the correction value D4 to the required driving pulse width P1 (step S22). The corrected pulse width P2 is used as corrected pulse width P2 for driving the solenoid 16 in the next fuel injection by the electromagnetic fuel injection pump 2 (step S23). The corrected pulse width P2 is stored in the memory (not shown) in the microcomputer 13, and is used as a driving pulse width P2 for specifying a period during which the FET 14 is ON in the next driving of the solenoid 16 (time "t3" in FIG. 5).

Figure 19:
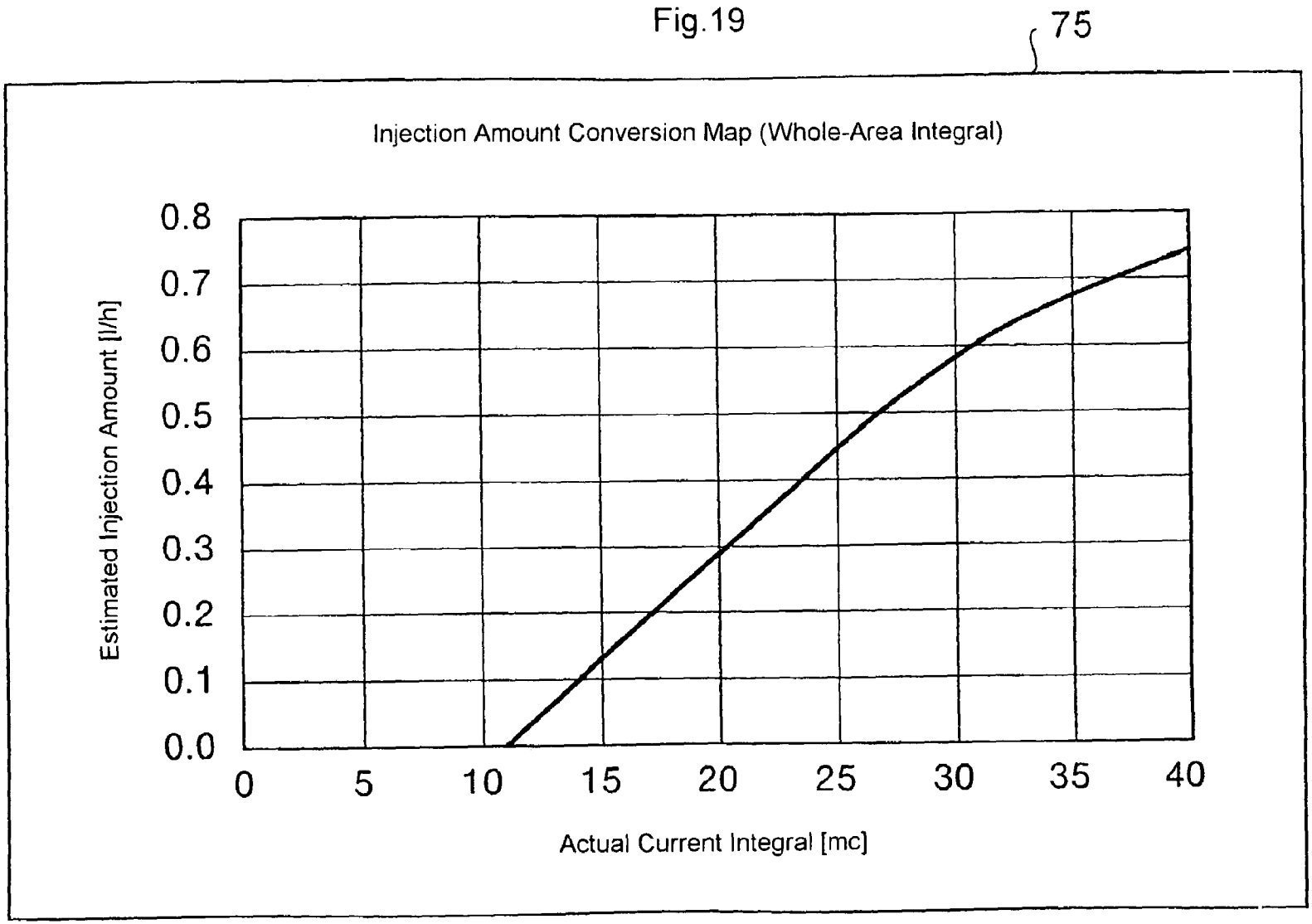
FIG. 19 shows an example of an injection amount conversion map used in whole-area integral.
Figure 20:
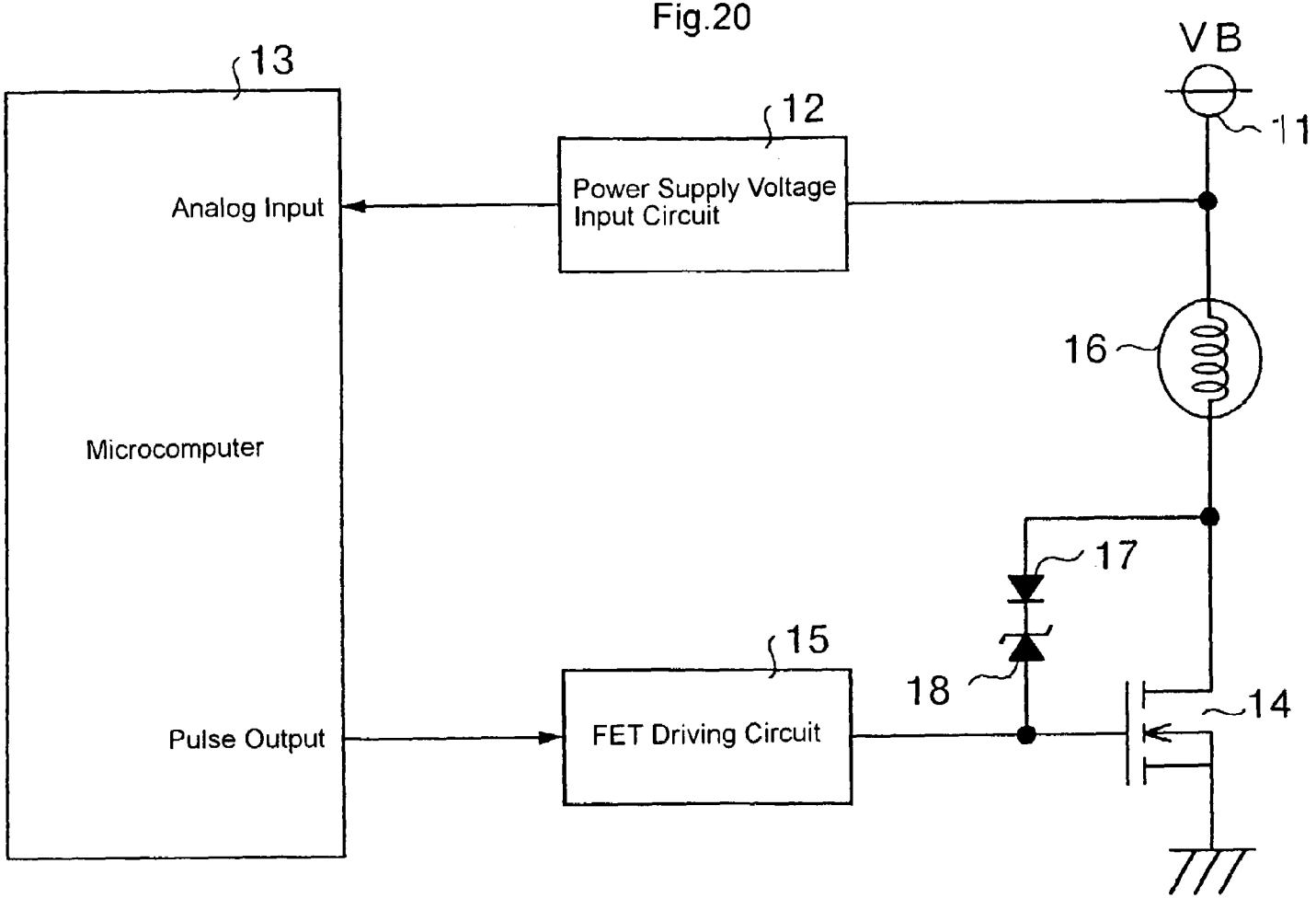
FIG. 20 illustrates a control mechanism of a conventional fuel injection apparatus that performs correction based on power supply voltage.

The actual current integral D2 as described above corresponds to the integral (region M1 in FIG. 5) of the coil current flowing through the solenoid 16 for a period of time the driving pulse width P1 is output. The injection amount conversion map 75 as illustrated in FIG. 17 is set by associating the relationship between the actual current integral D2 and estimated injection amount p2 with the region M1. The present invention is not limited to the foregoing, and it is also possible to set the injection amount conversion map for, as the actual current integral D2, the whole-area integral (region M1+M2 in FIG. 5) until the coil current flowing through the solenoid 16 reaches 0. FIG. 19 is a graph showing the injection amount conversion map 75 used in such a whole-area integral. Further, setting the actual current integral D2 beforehand in relation to the estimated injection amount p2 allows the same usage.

Thus, according to the third embodiment, using the actual current integral D2 enables the driving pulse width P1 to be corrected, and the microcomputer 13 is capable of fetching the actual current integral D2 during a period of time the solenoid 16 is OFF, i.e., the fuel injection is halted, with a margin for time, thus overcoming restrictions on timing for fetching the integral. Further, the feedback control is carried out in consideration of the integral p4 of the difference p3 between the required injection amount p1 and estimated injection amount p2, and variations in power supply voltage, and it is thus possible to perform correction with higher accuracy.

As a modification of the third embodiment, as in the modifications of the first and second embodiments, it is possible that the actual current integral of the coil current flowing after driving the solenoid is detected at real time, the estimated injection amount is calculated based on the real-time actual current integral, and the driving of the solenoid is halted at the time the estimated injection amount reaches the required injection amount.

The present invention relates to an electronic fuel injection control method and apparatus for supplying fuel to an engine for a vehicle, for example, intends to more accurately supply a fuel injection amount required from the engine side while eliminating effects due to variations in coil resistance of a fuel injection solenoid and others generated by variations in power supply voltage and in temperature, and thus has the industrial applicability.

What is claimed is:

1. A fuel injection control method comprising the steps of:

starting driving of a fuel injection solenoid;

detecting an actual current integral of a coil current that flows through the solenoid after starting the driving of the solenoid;

comparing the actual current integral with a reference current integral beforehand set in relation to a driving pulse width for the solenoid corresponding to a required fuel injection amount; and correcting the driving pulse width for the solenoid based on comparison between the actual current integral and the reference current integral, wherein the driving of the solenoid is controlled based on the driving pulse width corrected.

2. A fuel injection control method comprising the steps of:

starting driving of a fuel injection solenoid;

detecting an actual current integral of a coil current that flows through the solenoid after starting the driving of the solenoid;

comparing the actual current integral with a reference current integral beforehand set in relation to a driving pulse width for the solenoid corresponding to a required fuel injection amount; and halting the driving of the solenoid at the time the actual current integral reaches the reference current integral.

3. A fuel injection control method comprising the steps of:

starting driving of a fuel injection solenoid;

detecting an actual current integral of a coil current that flows through the solenoid after starting the driving of the solenoid;

comparing the actual current integral with a target current integral beforehand set in relation to a required fuel injection amount; and correcting a driving pulse width for the solenoid based on comparison between the actual current integral and the target current integral, wherein the driving of the solenoid is controlled based on the driving pulse width corrected.

4. A fuel injection control method comprising the steps of:

starting driving of a fuel injection solenoid;

detecting an actual current integral of a coil current that flows through the solenoid after starting the driving of the solenoid;

comparing the actual current integral with a target current integral beforehand set in relation to a required fuel injection amount; and halting the driving of the solenoid at the time the actual current integral reaches the target current integral.

5. A fuel injection control method comprising the steps of:

starting driving of a fuel injection solenoid;

detecting an actual current integral of a coil current that flows through the solenoid after starting the driving of the solenoid;

calculating an estimated fuel injection amount corresponding to the actual current integral;

comparing the estimated fuel injection amount with a required fuel injection amount; and correcting a driving pulse width for the solenoid based on comparison between the estimated fuel injection amount and the required fuel injection amount, wherein the driving of the solenoid is controlled based on the driving pulse width corrected.

6. A fuel injection control method comprising the steps of:

starting driving of a fuel injection solenoid;

detecting an actual current integral of a coil current that flows through the solenoid after starting the driving of the solenoid;

calculating an estimated fuel injection amount corresponding to the actual current integral;

comparing the estimated fuel injection amount with a required fuel injection amount; and halting the driving of the solenoid at the time the estimated fuel injection amount reaches the required fuel injection amount.

7. The fuel injection control method according to claim 1, further comprising the step of:

resetting the actual current integral every driving cycle of the fuel injection solenoid.

8. A fuel injection control apparatus comprising:

driving means for driving a fuel injection solenoid;

detecting means for detecting an actual current integral of a coil current flowing through the solenoid; and control means for controlling driving of the solenoid based on the actual current integral, wherein the control means comprises:

comparing means for comparing the actual current integral obtained after starting driving of the solenoid detected in the detecting means with a reference current integral beforehand set in relation to a driving pulse width for the solenoid corresponding to a required fuel injection amount; and correcting means for correcting the driving pulse width for the solenoid based on a result of comparison in the comparing means.

9. The fuel injection control apparatus according to claim 8, wherein the control means comprises comparing means for comparing the actual current integral obtained after starting driving of the solenoid detected in the detecting means with a reference current integral beforehand set in relation to a driving pulse width for the solenoid corresponding to a required fuel injection amount, and halts the driving of the solenoid by the driving means at the time the actual current integral reaches the reference current integral.

10. The fuel injection control apparatus according to claim 8, wherein the control means comprises:

comparing means for comparing the actual current integral obtained after starting driving of the solenoid detected in the detecting means with a target current integral beforehand set in relation to a required fuel injection amount; and correcting means for correcting a driving pulse width for the solenoid based on comparison between the actual current integral and the target current integral.

11. The fuel injection control apparatus according to claim 8, wherein the control means comprises comparing means for comparing the actual current integral obtained after starting driving of the solenoid detected in the detecting means with a target current integral beforehand set in relation to a required fuel injection amount, and halts the driving of the solenoid by the driving means at the time the actual current integral reaches the target current integral.

12. The fuel injection control apparatus according to claim 8, wherein the control means comprising:

calculating means for calculating an estimated fuel injection amount corresponding to the actual current integral obtained after starting driving of the solenoid;

comparing means for comparing the estimated fuel injection amount with a required fuel injection amount; and correcting means for correcting a driving pulse width for the solenoid based on comparison between the estimated fuel injection amount and the required fuel injection amount.

13. The fuel injection control apparatus according to claim 8, wherein the control means comprises:

calculating means for calculating an estimated fuel injection amount corresponding to the actual current integral obtained after starting driving of the solenoid; and comparing means for comparing the estimated fuel injection amount with a required fuel injection amount, and halts the driving of the solenoid by the driving means at the time the estimated fuel injection amount reaches the required fuel injection amount.

14. The fuel injection control apparatus according to claim 8, wherein the detecting means for detecting the actual current integral is an analog detecting circuit that detects a cumulative current value of the coil current or a digital detecting circuit that measures a value of the coil current at predetermined intervals to calculate.

15. The fuel injection control method according to claim 2, further comprising the step of:

resetting the actual current integral every driving cycle of the fuel injection solenoid.

16. The fuel injection control method according to claim 3, further comprising the step of:

resetting the actual current integral every driving cycle of the fuel injection solenoid.

17. The fuel injection control method according to claim 4, further comprising the step of:

resetting the actual current integral every driving cycle of the fuel injection solenoid.

18. The fuel injection control method according to claim 5, further comprising the step of:

resetting the actual current integral every driving cycle of the fuel injection solenoid.

19. The fuel injection control method according to claim 6, further comprising the step of:

resetting the actual current integral every driving cycle of the fuel injection solenoid.

* * * * *